United States Patent [19]

Walton et al.

[11] Patent Number: 5,060,349

[45] Date of Patent: Oct. 29, 1991

[54] COMPRESSIVE TREATMENT OF WEBS

[75] Inventors: Richard R. Walton, Ten West Hill Pl., Boston, Mass. 02114; George E. Munchbach, Roslindale; Sandra M. Ellingson, Boston, both of Mass.

[73] Assignee: Richard R. Walton, Boston, Mass.

[21] Appl. No.: 258,629

[22] Filed: Oct. 17, 1988

Related U.S. Application Data

[63] Continuation-in-part of Ser. No. 035,268, Apr. 2, 1987.

[51] Int. Cl.[5] ..... D06C 21/00; D06C 23/04

[52] U.S. Cl. ..... 26/18.6; 26/18.5; 162/111; 162/280; 162/361; 264/282

[58] Field of Search ..... 26/18.6; 264/282; 162/111, 280, 361, 205, 206

[56] References Cited

U.S. PATENT DOCUMENTS

| | | | |
|---|---|---|---|
| 2,494,334 | 1/1950 | Dorst | 26/28.6 |
| 2,567,967 | 9/1951 | Rowe . | |
| 2,915,109 | 12/1959 | Walton . | |
| 3,163,575 | 12/1964 | Nobbe | 162/111 |
| 3,260,778 | 7/1966 | Walton . | |
| 3,426,405 | 2/1969 | Walton . | |
| 3,427,376 | 2/1969 | Dempsey . | |
| 3,452,409 | 7/1969 | Trifunovic et al. . | |
| 3,597,814 | 8/1971 | Trifunovic et al. . | |
| 3,641,234 | 2/1972 | Trifunovic et al. | 264/282 |
| 3,681,819 | 8/1972 | Trifunovic et al. . | |
| 3,810,280 | 5/1974 | Walton et al. . | |
| 3,869,768 | 3/1975 | Walton et al. . | |
| 3,975,806 | 8/1976 | Walton et al. . | |
| 4,090,385 | 5/1978 | Packard . | |
| 4,142,278 | 3/1979 | Walton et al. . | |
| 4,432,927 | 2/1984 | van Tilburg . | |
| 4,704,113 | 11/1987 | Schoots . | |
| 4,717,329 | 1/1988 | Packard et al. | 162/280 |

FOREIGN PATENT DOCUMENTS 2361222 3/1978 France .

*Primary Examiner*—Werner H. Schroeder
*Assistant Examiner*—Bibhu Mohanty
*Attorney, Agent, or Firm*—Fish & Richardson

[57] ABSTRACT

A web treating machine and method employing a web-gripping drive surface, a primary member that presses the web against the drive surface, and a stationary retarding surface, supported by a sheet form member, that retards the web before it leaves the drive surface, has the following of features. The sheet form support member is elastically deflectable. A tip deflector applies deflecting pressure on the downstream end of the support member to deflect the support member toward the drive member. A cavity stabilizer, in the form of a second sheet form member, extends in face-to-face reinforcing relationship over the initial portion of the support member in the region immediately downstream of the primary member, the portion of the support member extending between the cavity stabilizer and the tip deflector being relatively unreinforced. The cavity stabilization and tip deflection is obtained by deflection of various spring members, in one instance an advantageous gull-wing form being achieved. Both curved and flat web-driving surfaces are employed. The support member is elastically deflectable about the curved drive surface by applied tip pressure from a relatively straight unstressed shape to a bowed, elastically deformed shape that generally conforms to the curvature of the drive surface. Retarding surfaces shown include sets of ridges and grooves angled to the direction of web drive. Special formations of the retarding surfaces achieve special effects such as a tree bark appearance.

34 Claims, 16 Drawing Sheets

14
18
18'
20
22
24
26
G
S

COMPRESSIVE TREATMENT OF WEBS

This application is a continuation-in-part of U.S. application Ser. No. 035,268, filed Apr. 2, 1987.

BACKGROUND OF THE INVENTION

This invention relates to the compressive treatment of webs in which a stationary retarding surface acts upon the outer surface of a driven web to cause the web to slow and longitudinally compact or crepe in a treatment zone. This technique, sometimes referred to as bladeless microcreping because of its avoidance of the use of a blade retarder and its ability to produce fine crepes, is exemplified by our prior U.S. Pat. No. 3,810,280, which is herein incorporated by reference.

With this bladeless technique it has been found difficult to obtain the desired level of uniformity of treatment under commercial conditions and at commercial speeds. For example, as speeds have been increased, unwanted non-uniformities have occurred across the width of the web in some cases or in the longitudinal direction, or the characteristics resulting from the treatment have been different over the range of operational speeds. In other cases the characteristics that result from the treatment have been sensitive to slight change in temperature or adjustment, making the technique inappropriate for commercial adoption. In some cases, prior implementations of the bladeless technique have caused snagging or surface abrasion or other harm to the web.

For such reasons the commercial use of this technique has been limited, despite its potential advantages and the importance of the possible fields of application. An example of an important field is that of denim fabrics, in which mechanical treatment by the technique, if perfected, has wide potential. Another example is the field of specialty fabrics, where mechanical treatment is desired for giving to rather inexpensive or low quality fabrics, characteristics that enhance their value and quality.

The bladeless technique is applicable to compaction of webs in which components of the web, e.g. a knit or woven material, are longitudinally compacted with extreme uniformity and without introduction of crepe, and to various degrees of creping, from the finest microcrepe to rather gross crepe, or combinations of primary and secondary crepes or decorative effects. In some cases tension is applied to the treated web to remove some or even most of the treatment, e.g. where it is desired mainly to soften the web or render it pliable. In addition to textile fabrics the technique is applicable to a wide range of nonwoven fabrics, papers and other web-form flexible sheets and the like.

Various aspects of the present invention are believed to meet, in a commercially practical manner, the needs mentioned above as well as others that are encountered in the longitudinal compressive treatment of webs.

Certain aspects of the invention are applicable to other web treatment machines besides the bladeless microcreper.

SUMMARY OF THE INVENTION

One aspect of the invention relates to a web treating machine and method employing a drive member having a web-gripping drive surface, a smooth surfaced primary member arranged over the drive member to press the web into driven engagement with the surface of the drive member, and a generally stationary retarding surface arranged after the primary surface to engage and retard the web before the web has left the drive member, the retarding surface being supported by a sheet form support member. According to this aspect of the invention, the sheet form support member is elastically deflectable, a tip deflector is constructed and arranged to apply deflecting pressure on the downstream end portion of the support member to deflect the support member toward the drive member, there being a cavity stabilizer in the form of a second sheet form member which extends in face to-face reinforcing relationship over the initial portion of the support member in the region immediately downstream of the primary member, the portion of the support member extending between the cavity stabilizer and the tip deflector being relatively unreinforced.

In one important category of embodiments, the web gripping drive surface is of curved form, as provided by the surface of a cylindrical roll, or a belt travelling over a roll, and the sheet form support member is elastically deflectable about the curved drive surface by applied tip pressure from a relatively straight unstressed shape to a bowed, elastically deformed shape that generally conforms to the curvature of the drive surface.

Preferred embodiments of these aspects of the invention have the following features.

The tip deflector is comprised of a sheet spring member in face-to face engagement with the upper surface of the end portion of the support member. The tip deflector and the cavity stabilizer comprise spaced apart portions of a supplemental sheet spring member, the portion of the supplemental sheet spring member that defines the tip deflector being in face-to-face engagement with the upper surface of the end portion of the support member. The supplemental sheet spring member has, in unstressed condition, a precurved, outwardly convex portion spanning between the portions that define the cavity stabilizer and the tip deflector. The primary member is of sheet form, an extension of the supplemental sheet spring member extends upstream of the portion that defines the cavity stabilizer, the extension lying over the primary member, and a presser member presses the extension downwardly whereby the extension in turn can press the primary member downwardly into engagement with the web, the members constructed and arranged such that the downward pressure of the presser member serves to urge the tip deflector and the cavity stabilizer portions of the supplemental sheet spring member into engagement with respective portions of the support member.

In unstressed condition, the upstream extension of the supplemental sheet member is precurved, outwardly convex over a region immediately upstream of the presser member, as a continuation of the curve of the supplemental member downstream of the presser member. The presser member comprises a presser edge that extends in the direction perpendicular to the direction of treatment, in the case where the shape of the drive surface is defined by a roll, the presser edge extending in the direction of the length of the roll. And the supplemental sheet spring member is constructed and arranged so that in operating position the presser member locally, elastically deflects the sheet spring member into a slightly reversely curved, outwardly concave form whereby in the region of the presser member and immediately upstream and downstream thereof, the sheet spring member has a stable prestressed, generally gull-wing shape.

Preferred embodiments of various aspects of the invention also have the following features.

The primary member comprises a sheet metal member, and upstream extensions of the primary member, the support member and the supplemental sheet spring member extend upstream to a common holder which grips them face-to-face. Useful e.g. where the driven member is a roll having a diameter of the order of twelve inches or greater, the support member is of blue steel having thickness greater than about 0.010 inch. The thickness of the support member is less than about 0.020 inch. A supplemental sheet form member forms the tip deflector and cavity stabilizer, the supplemental sheet form member being of blue steel and thickness greater than about 0.010 inch and no thicker than about the thickness of the support member. A smooth sheet form, low-friction roof member extends downstream a limited distance from the end of the primary member to the effective beginning of the retarding surface. The roof member is comprises of blue steel of a sheet of about 0.003 inch thickness and extends downstream from the end of the primary member no more than about one half inch. The retarding surface commences at the end of the primary member. The retarding surface has an effective downstream extent of between about ½ and 1½ inches. The retarding surface is defined by an emery sheet lying below the support member. The retarding surface is formed integrally with the under surface of the support member. The retarding surface comprises a large multiplicity of successive ridges and grooves set acutely to the machine direction and preferably having a non-harmful low friction surface such as polished metal. For producing a tree bark effect or the like, including plisses, a widthwise distribution of interruptions of a surface is provided in the region of the treatment cavity, e.g. open space in the retarding surface such as holes, slits or slots in emery cloth that provides the retarding surface, or deformations in the end of the primary member.

Another aspect of the invention relates to a web treating machine and method employing a drive member having a web-gripping drive surface, a smooth-surfaced sheet-form primary member arranged over the drive member to press the web into driven engagement with the drive surface, a presser member defining a presser edge for pressing the primary member against the drive member and a generally stationary retarding surface arranged after the primary surface to engage and retard the web before the web has left the drive member, the retarding surface being supported by a sheet spring member which has a rearward portion extending rearwardly over the primary member and under the presser member. According to this aspect of the invention, the sheet spring member has, in unstressed condition, a precurved, outwardly convex portion spanning between a point upstream of the presser member edge to a region substantially downstream of the edge, the sheet spring member being constructed and arranged so that in operating position, the presser member locally elastically deflects the sheet spring member into a slightly reversely curved, outwardly concave form whereby in the region of the presser member and immediately upstream and downstream thereof the spring member has a stable prestressed generally gull-wing shape.

Preferred embodiments of this aspect of the invention have the following features.

In the operative position, spaced upstream of the presser member, the sheet spring member is bowed out of contact with the primary member as a result of the gull-wing shape. In operative position, immediately downstream of the presser member, the end of the primary member is reinforced against upward deflection by engagement of an upwardly concave portion of the gull-wing shape. In operative position the portion of the sheet spring member in the region of the tip of the primary member and immediately beyond is under a bend-resistant prestressed condition as a result of the gull-wing formation, thereby being resistant to deflection by deflection forces applied to the downstream tip of the sheet spring member. A sheet-form support member lies between the primary member and the sheet spring member, the sheet form support member extending downstream of the tip of the primary member to define a treatment cavity and the sheet spring member immediately beyond the primary member engaging the upper surface of the support member in reinforcing relation to resist change in the depth of the cavity at the end of the primary member. The sheet spring member is exposed to directly support a retarding surface. The retarding surface is defined by emery cloth extending below the sheet spring member. The retarding surface is defined by an abrasive coating carried on the under surface of the sheet spring member. The retarding surface is defined by a large multiplicity of successive ridges and grooves set at acute angle to the machine direction and preferably having a non-harmful surface formed of polished metal.

DESCRIPTION OF DRAWINGS

In the drawings:

FIGS. 2, 2*a*, 2*b* and 2*c* show four successive positions of the head of the machine as it moves from retracted position to its operative position while FIG. 2*d* shows the gull-wing form spring element in isolation and FIG. 2*e* is a magnified view of the presser region of the machine of FIG. 1 while

FIG. 4*a* is a magnified view of a portion of FIG. 4 and also showing holes formed in the emery while

FIG. 5 is a view similar to FIG. 3 of an embodiment employing a grooved and ribbed retarding surface while

DETAILED DESCRIPTION OF PREFERRED EMBODIMENTS

Figure 1:
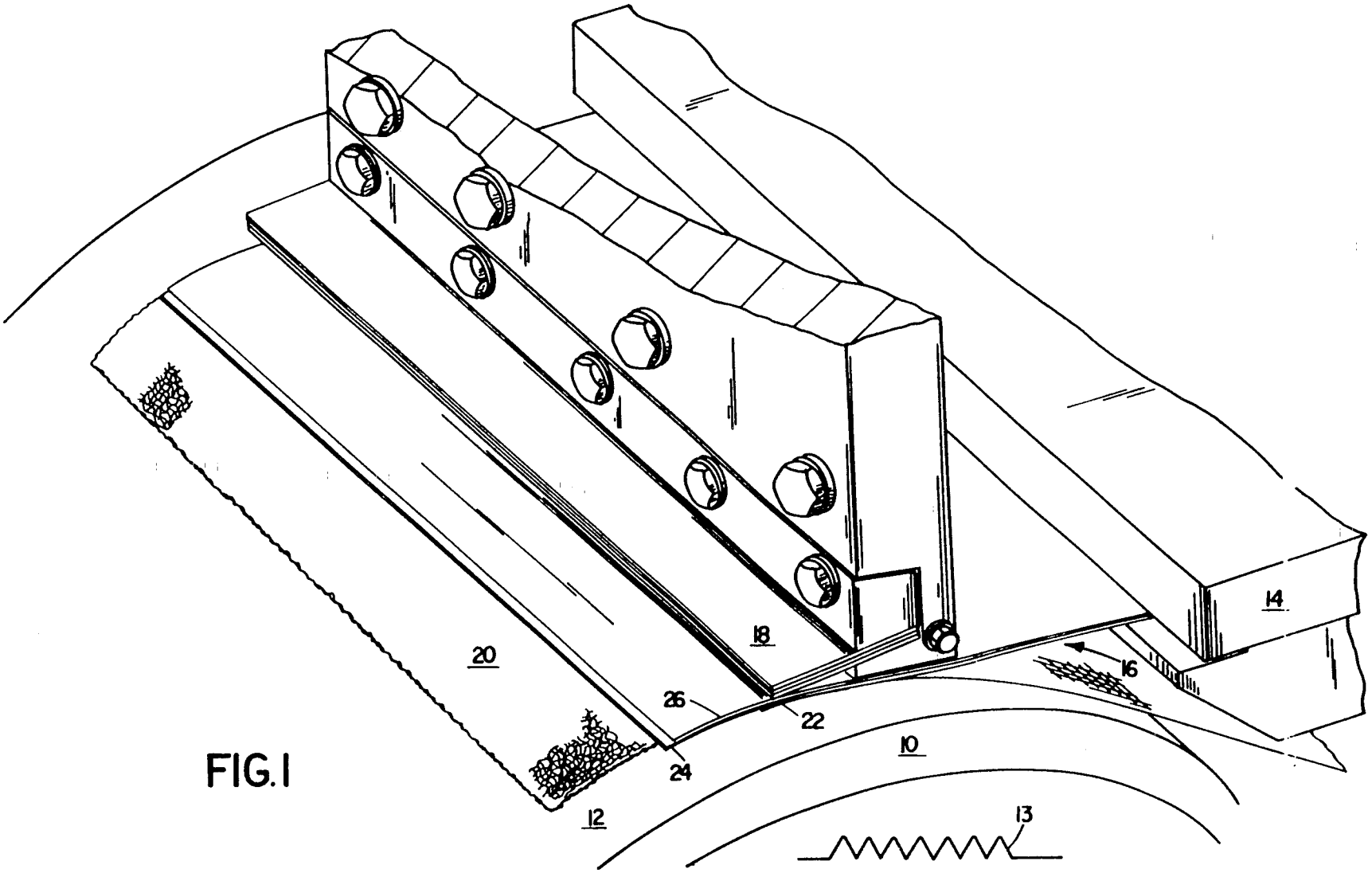
FIG. 1 is a perspective view, partly broken away, of a preferred embodiment of a machine according to the invention in operative position.
Figure 2:
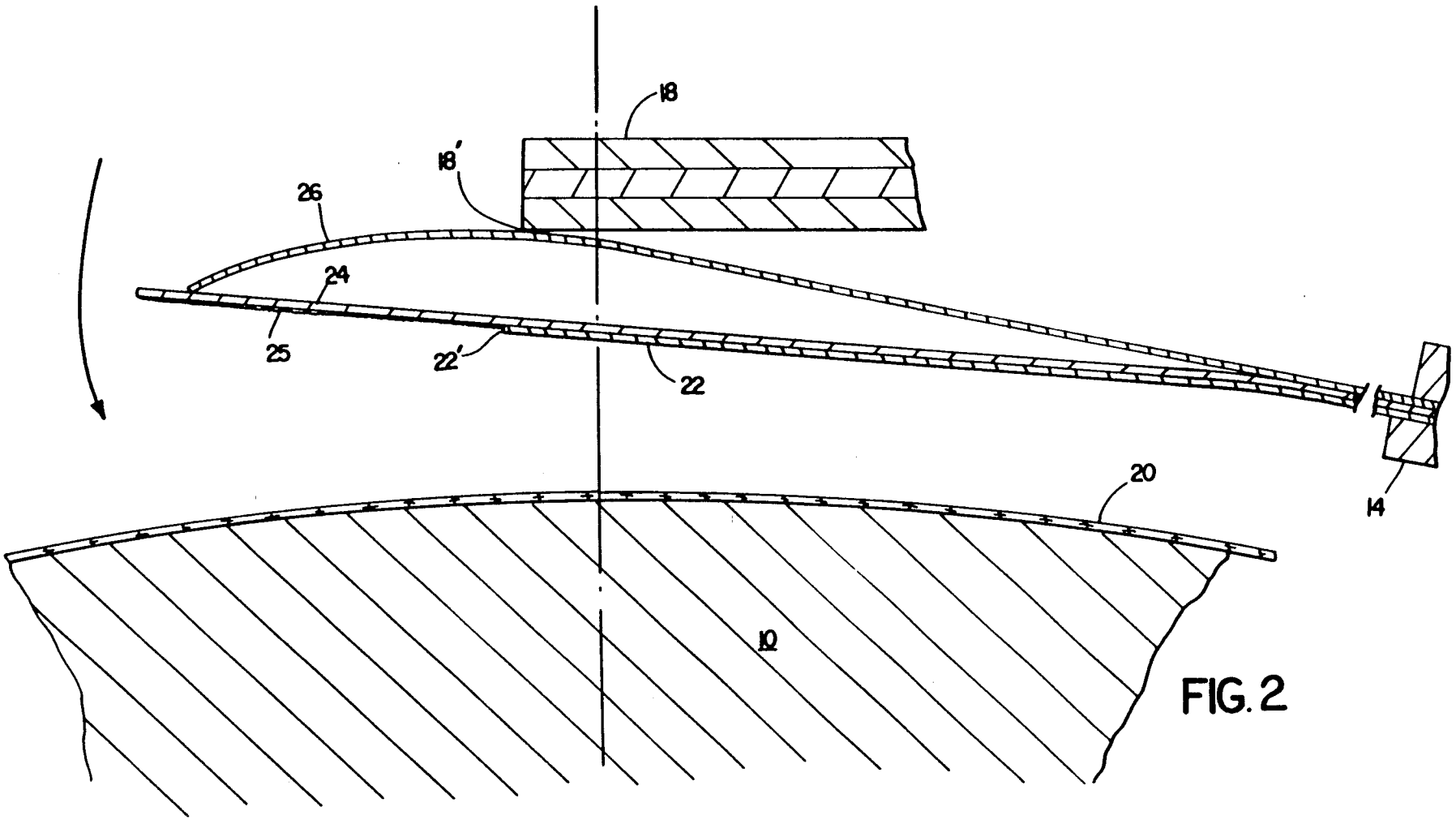

Referring to FIGS. 1 and 2 a rotatable driven steel roll 10 has a web-gripping surface 12 provided by fine carbide particles applied by plasma coating. The roll, of e.g. 12 inch diameter, contains thermostatically controlled internal heaters denoted schematically at 13.

An assembly 16 of sheet form members is mounted in a holder 14 and extends forward, in cantilever fashion. The assembly passes under presser member 18 and over roll surface 12 where it engages the outer surface of web 20 on the roll.

From the bottom up, assembly 16 consists of a primary member 22, a sheet-form spring member 24 which supports a retarding surface 25, and a second sheet-form spring member 26 of specially curved form.

More particularly, primary member 22 has a smooth under-surface and is arranged, by the influence of presser member edge 18′, to press web 20 into driven engagement with the surface 12 of driven roll 10. The downstream edge 22′ of primary member 22 lies slightly downstream from alignment with presser member edge 18′. The thickness of the primary member 22 will vary depending upon the nature of the web to be treated and the type of treatment desired. Whereas it may be 0.010 inch thick and reduced by grinding to a much lesser thickness in its edge region when compaction is desired under the final margin of the primary member, it may be of much greater thickness, for instance, 0.030 or 0.040 inch and made up, e.g. of a number of overlying sheet spring members, when it is desired to define a creping cavity of that dimension just beyond the end of the primary member.

The sheet-form spring member 24, in unstressed condition, is a straight planar member, of thickness selected on the basis of being deflectable by pressure applied at its tip to elastically conform to the curvature of the roll. It is also capable of spanning over a selected, relatively unsupported length to provide resilient engagement with the web without adversely deforming or "bubbling" under outward pressure exerted by the web. For retarding passages having a length of about one half to one inch, and for a roll of 12 inch diameter, operating under usual commercial operating conditions, this first planar sheet spring member, when of blue steel, should be of thickness no less than about 0.010 inch, and may range up to about 0.020 inch for commercial conditions in which extreme ruggedness is required. For certain other operating conditions where less demand is placed upon the support member 24, the requirements can be relaxed, e.g. for a web that is soft and requires little treatment force or where secondary or irregular crepes are to be formed.

In the embodiment of FIG. 1 a retarding surface is provided as an integral layer of fine carbide particles applied by plasma coating to the undersurface of this first spring member 24.

Figure 1A:
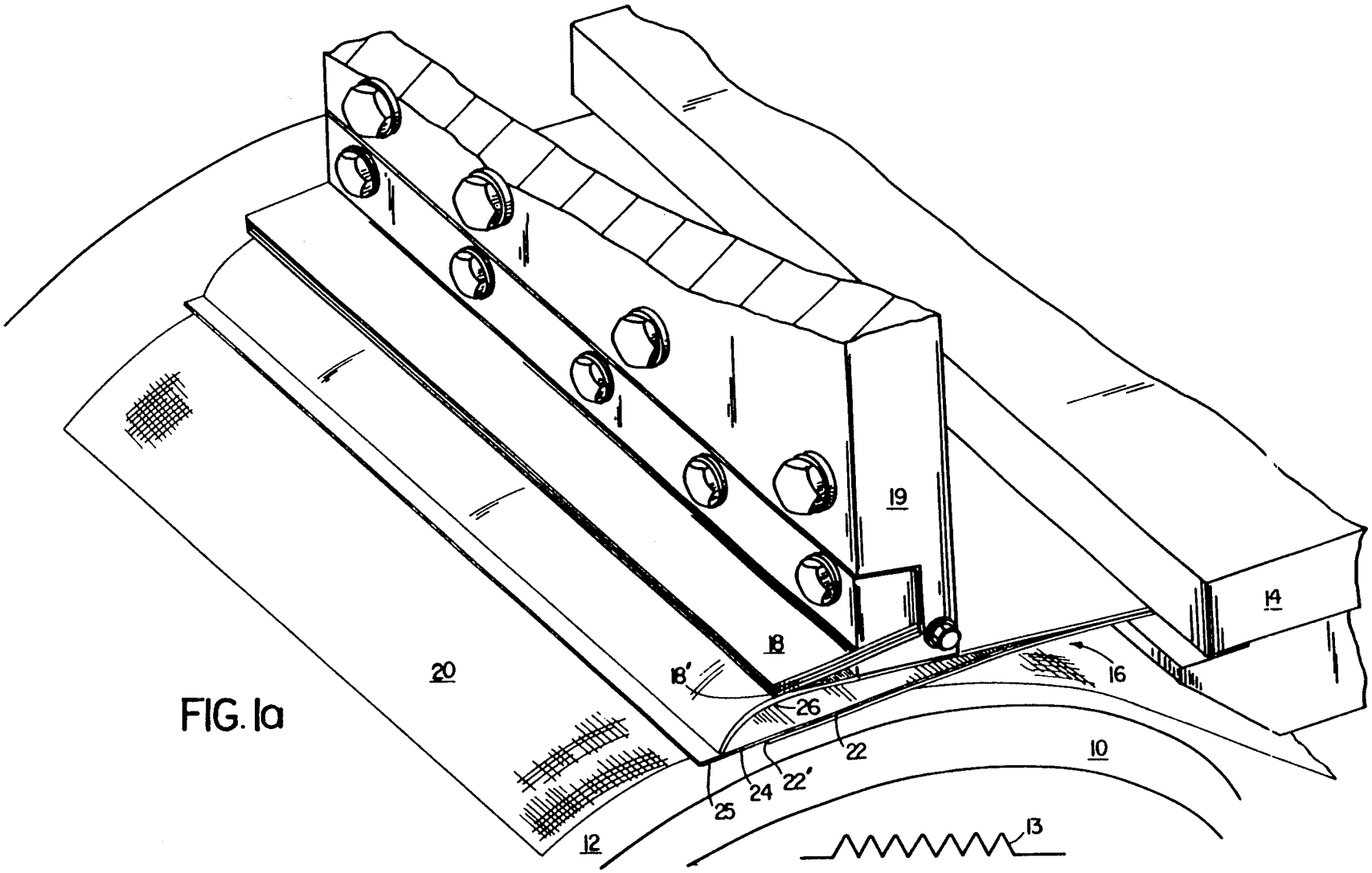
FIG. 1*a* is a view, similar to FIG. 1, of the machine, with the head in a retracted, non-operative position.

The second spring member, in unstressed condition (see FIG. 1*a*), has a special precurved shape. Starting at a point lying well behind the point of alignment with the presser member edge 18′, the sheet member in unstressed condition has an outwardly convex curvature, extending to its tip. This curvature is less than that of the roll, in the present example the radius being about two inches. The thickness of this member is selected to enable the member to be deflectable under operational loading to provide treatment cavity stabilization and tip loading of the first spring member in the manner to be described, while allowing a span of the first member between these two regions to be relatively unsupported. It is preferred in most instances that this second member be of substance no stiffer than the first member. For the example at hand, using a 12 inch diameter roll and a retarding passage of ½ inch to 1 inch length, where the second member is of blue steel, this second supplemental member generally has a minimum thickness of about 0.010 inch and does not substantially exceed the thickness of the first member.

Figures 2A, 2B, 2C:
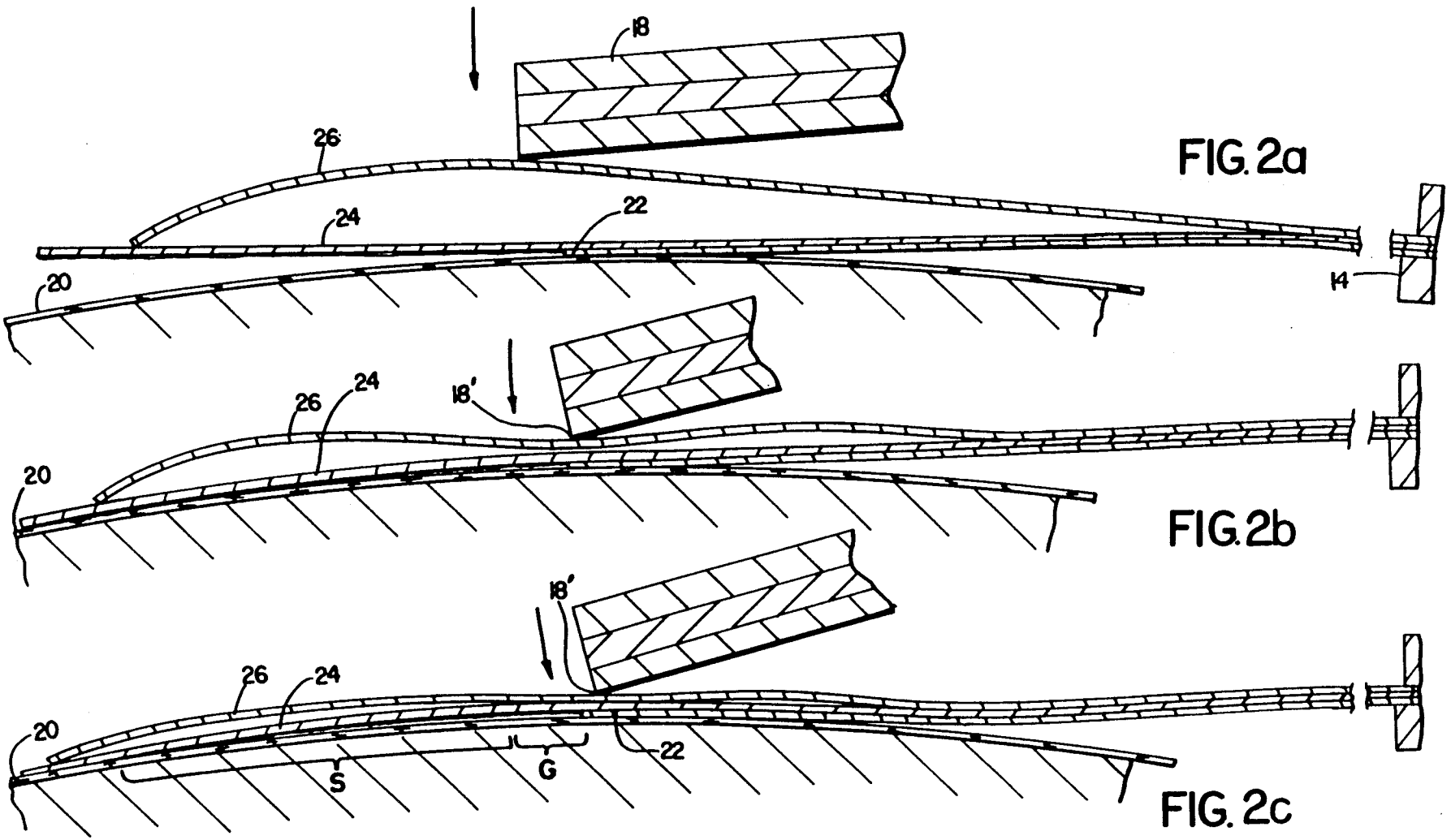

The sequence of FIGS. 2 to 2*c* shows the assembled relationship of the sheet-form members and their progressive elastic deformation as the head of the machine is lowered into operative position.

As shown in FIG. 2, all three sheet form members are clamped face-to-face by holder clamp 14, with the free end of the precurved, second sheet spring 26 engaged upon the first spring member 24 near the free tip of the latter. As a result of this clamping, some pressure is applied between the members, causing the first member 24 and the primary member 22 to be slightly deflected, as shown, form their original unstressed planar condition.

To reach the operative condition, the head, comprising the presser member 18, and its support 19, the holder 14 and the clamped assembly 16, are rotated as a unit by pneumatic actuators, not shown, through the positions of FIGS. 2*a* and 2*b* to the operative position of FIG. 2*c*.

FIG. 2*a* shows the primary member just as it engages web 20 on roll 10, with no change from FIG. 2 in the shape or stress of the sheet spring members.

FIG. 2*b* shows the subsequent condition in which the presser member edge 18′ has commenced deforming the second spring member 26, to cause local reversal of its curvature into a gull-wing formation. At this point the deformed portion of the second spring 26 has not yet contacted the first spring member 24.

Figure 2E:
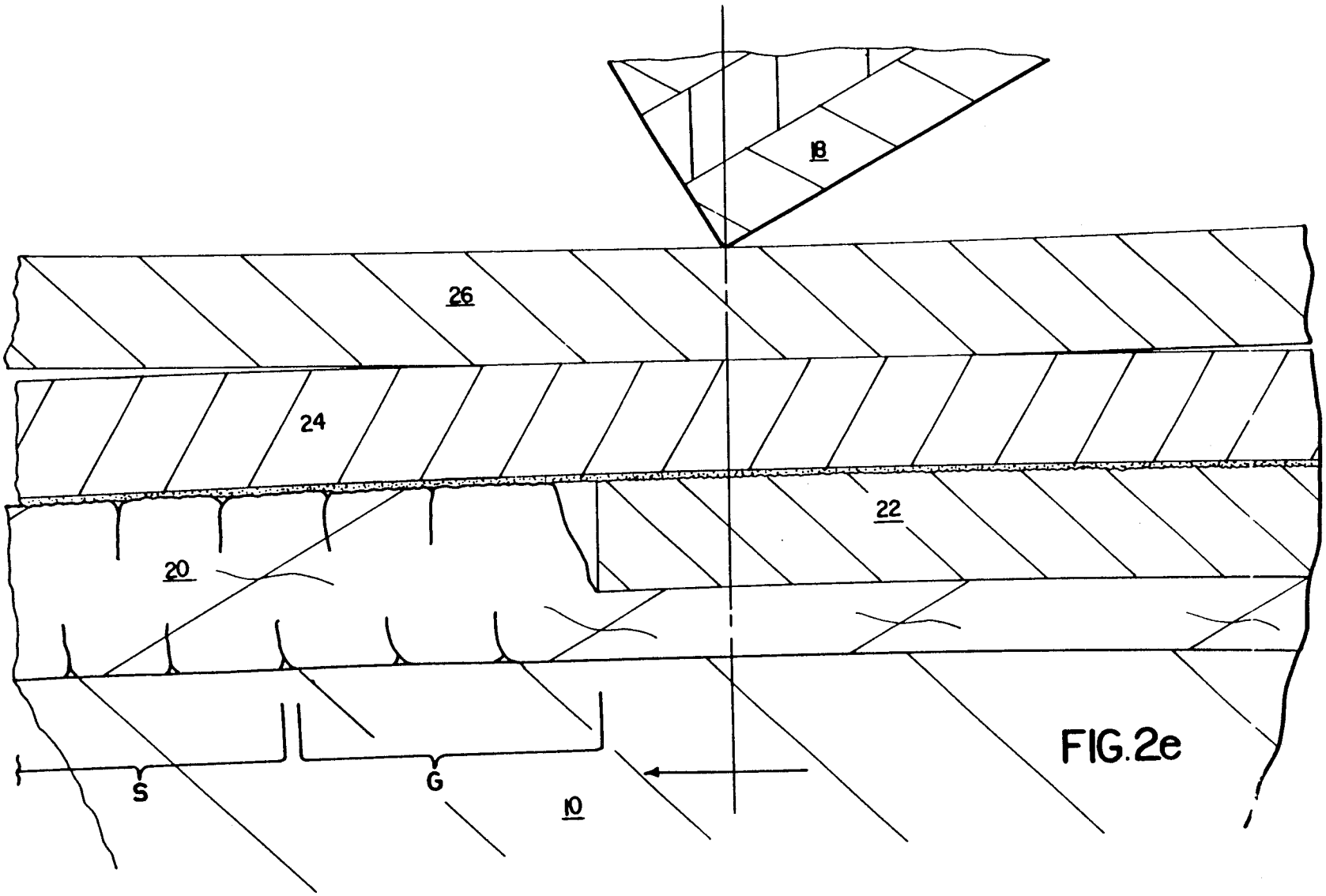

FIG. 2*c* and the magnified view of FIG. 2*e* show the result of further rotation of the head in which pressure of the presser member 18' is transmitted to the primary member 22. There is solid contact under edge 18' between the second member 26 and the first member 24, the first member 24 and the primary member 22, and the primary member 22 and the web 20. The first member is bowed convexly and conforms well to the roll, as a result of pressure applied to its tip region by the cantilevered end of spring member 25. Due to the preformed curvature of second member 26, a gull-wing formation is elastically imposed on the second member 26, see also FIG. 2*d* which shows the gull-wing formation in isolation. In the region of the end of primary member 22, the downwardly deformed part of the gull-wing formation engages the first member 24 face-to-face, region G, whereas downstream from there, over a spanning portion, S, toward the tip, the second spring member 26 does not provide the support to member 24 that it does upstream.

After the position of FIG. 2*c* is reached, pneumatic pressure on the actuators for the head is increased to operative level, which is selected depending upon the nature of the particular web to be driven and the nature of the treatment to be performed. A web more difficult to drive and retard requires more pressure of presser member than weaker webs. As some of the figures suggest, the web in the region of the presser is vertically compressed. Knits demonstrate this very substantially (e.g. a jersey knit may compress from 0.016 inch to 0.007 inch or sweat shirt knit from 0.070 to 0.030 inch), but all webs are compressed to some degree.

Figure 2F:
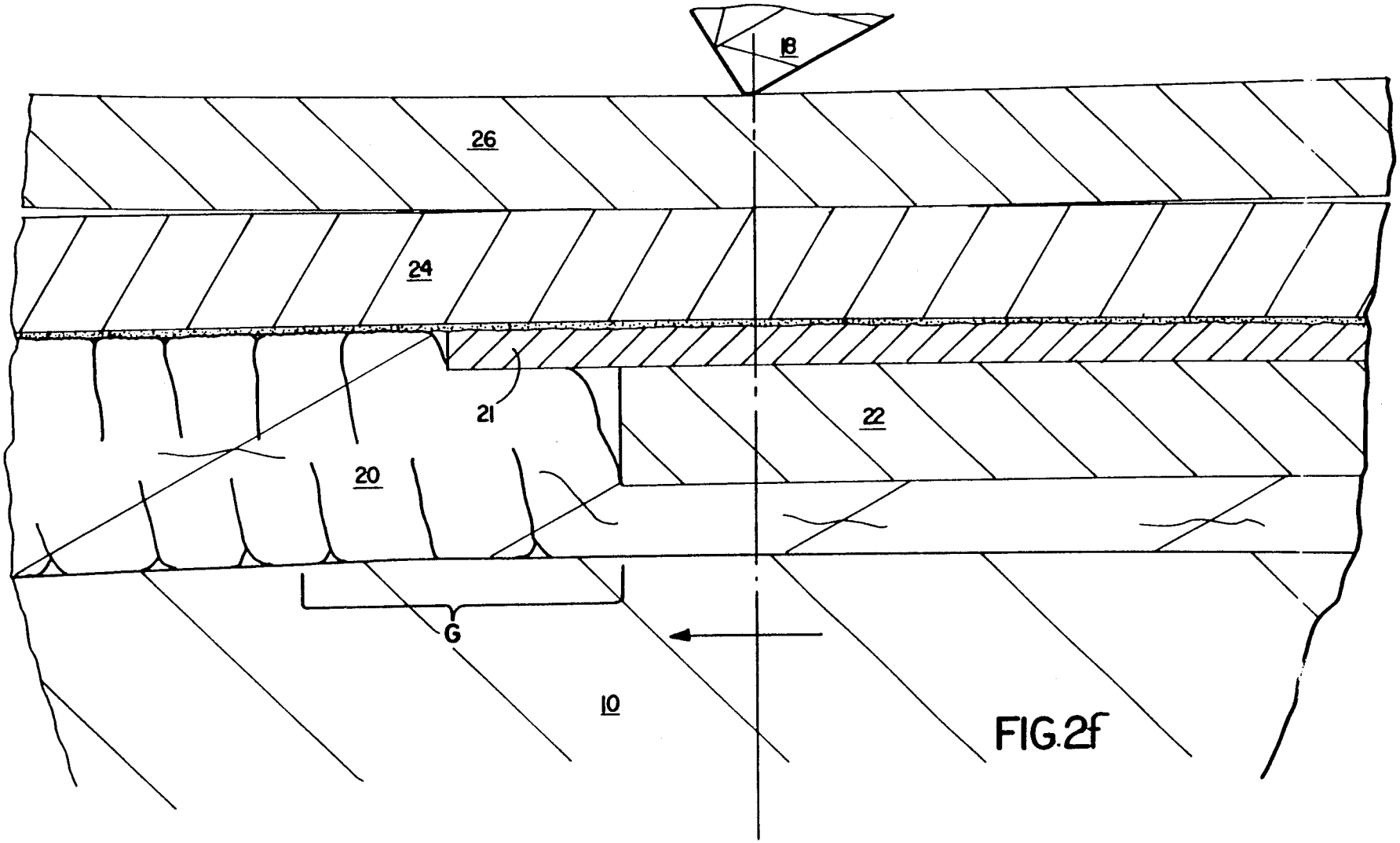
FIG. 2*f* is a similar view of an embodiment with a roof.
Figure 2D:
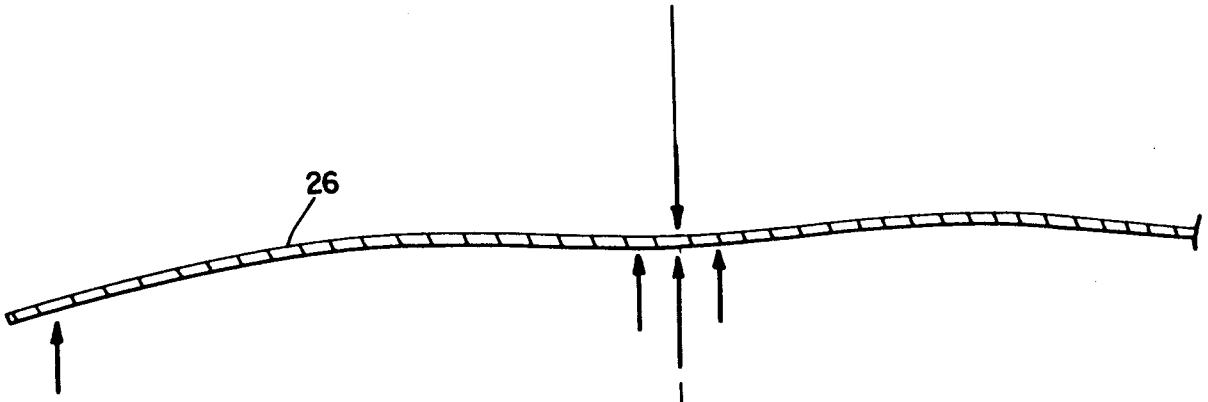

Referring to FIG. 2*f*, in certain instances, e.g. for soft fuzzy fabrics, a roof member 21 of, e.g., 0.003 inch is interposed between the primary member 22 and the support member 21 so that the web, as it emerges into the cavity at the end of the primary member, is bounded by a smooth surface rather than by a retarding surface. The roof may be as long as ½ inch. Following the roof, the web is then exposed to the retarding surface.

Figure 3:
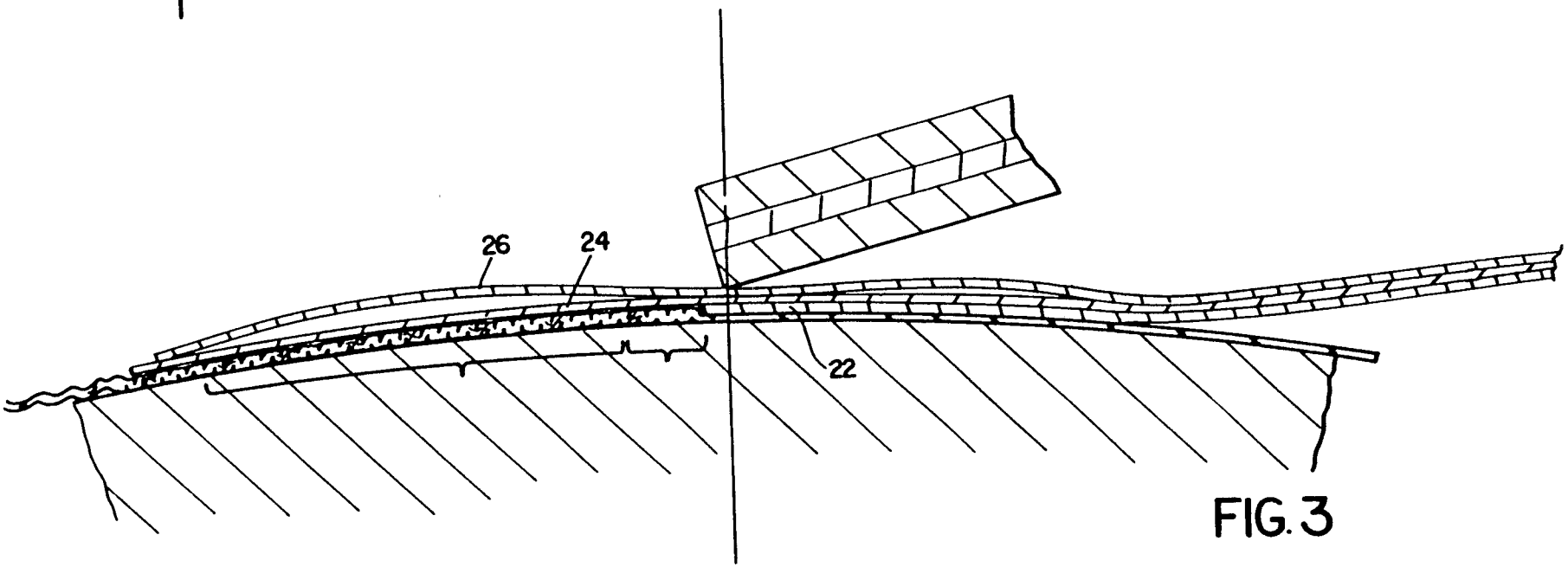
FIG. 3 is a view similar to FIG. 2*c*, set up to provide a creping treatment to a web using as a retarder surface a plasma-coated surface applied to the underside of a sheet metal spring member.

FIG. 3 represents an operative condition for creping a web. This process may be started slowly and then sped up to commercial production speeds. The dynamic conditions at higher speeds may tend to cause flutter in the downstream end of the member 24, but significant spring resistance applied at the tip by a second spring member 26 opposes this movement. Furthermore any tendency for the tip of member 24 to be raised does not propogate rearwardly, by what might be termined alligator jaw effect, to open unduly the treatment cavity at the immediate end of the primary member 22. Such opening is effectively resisted by a cavity-stabilizing effect produced by face-to-face contact of the gull-wing portion of the second spring member 26 in the region G. This stabilization is quite important because undue change in dimensions of the treatment cavity, whether of periodic nature associated with a flutter condition of the retarder or of a more constant but speed dependent nature, can have unacceptable effects upon the treatment. Similarly the downstream tip of the primary member is stabilized against adverse lifting effects applied on the downstream members.

Furthermore if take up tension applied to the web begins removing the treated material at too great a rate from the retarding passage, the closing down of the tip of member 24 under the influence of the tip loading of member 26, resists such tendency, ensuring that the retarding passage remains adequately filled.

Along the span S between the tip region and the stabilized cavity, the first member 24 retains a beneficial degree of outward resiliency, so that the material may work its way along under the retarding surface as a result of the driving force applied to the web by the driven roll. The resiliency of member 24 allows slight accomodating changes in the depth of the passageway in response to the web, so that slight variations in the thickness of the web can be accomodated without causing significant variation in the treatment condition.

As the overall result, the technique can produce very uniform treatment over a wide range of speeds while accommodating inherent variations in production conditions. This is achievable using elements which are quite rugged and which, after proper selection for the treatment at hand, require no adjustments of any of the elements in the lengthwise direction of the machine.

It is possible in certain instances to have the preformed curve of the second spring member begin at or after the presser member edge. But in many instances this is not nearly so advantageous as the illustrated form, in which the curve begins well behind the presser member. The gull-wing shape that results appears to impart a stronger stabilizing effect to the treatment cavity, perhaps as a result of greater prestress and structural stability in the inflection region of the sheet metal member where a transition occurs between opposite forms of curvature. To the rear of the presser member the upward bowing of the second member out of contact with the first spring member may also avoid imposing too great rigidity on the primary member. Thus, for instance, an ironing effect upon the web can be avoided, which could be detrimental to certain desired commercial treatments.

Figure 4:
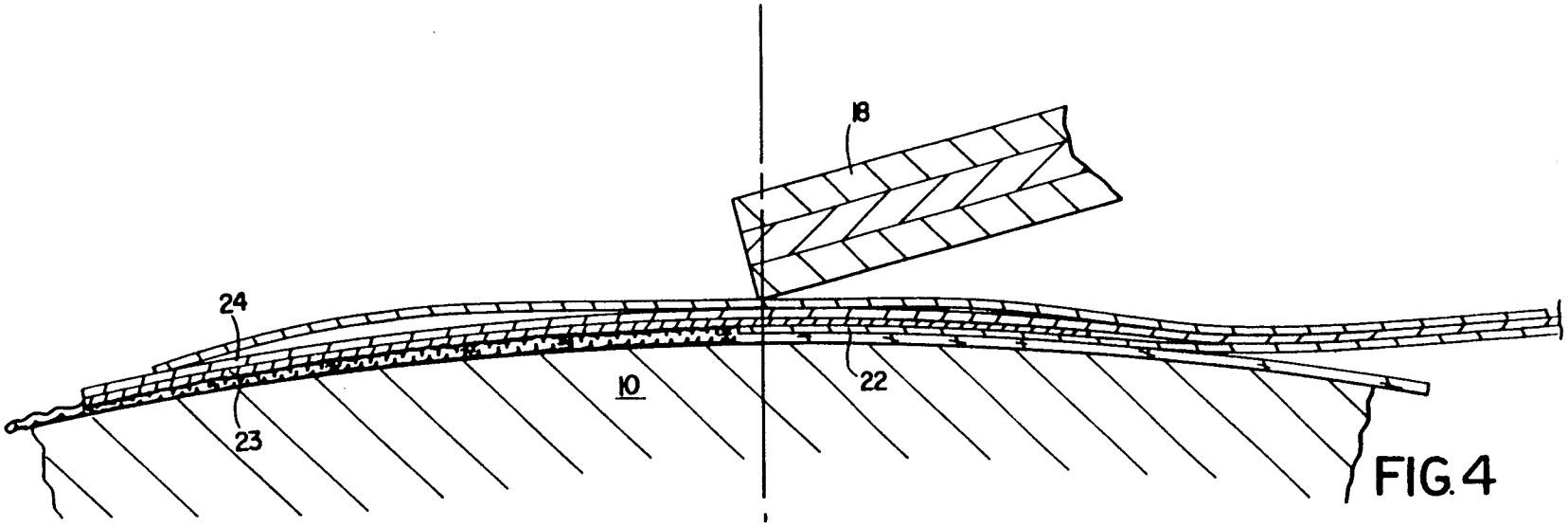
FIG. 4 is a view similar to FIG. 3 of a machine employing an emery-sheet retarder.

The embodiment of FIG. 4 is similar to that of FIG. 3 except that the retarding surface is provided by a sheet of emery cloth 23 which lies beneath the first spring sheet member 24, in a supported relationship. The emery is gripped upstream between the first spring member 24 and the primary member 22.

Figure 4A:
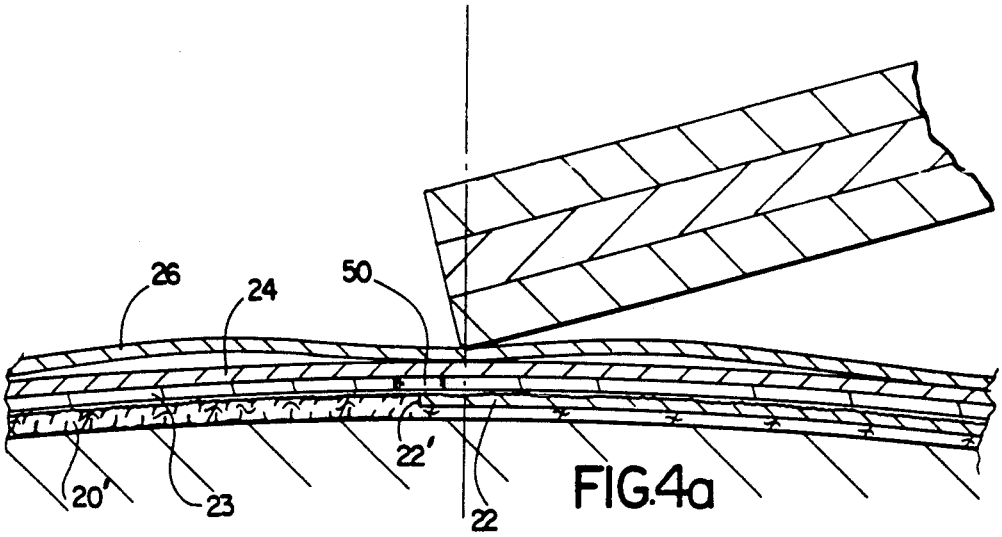
Figure 4B:
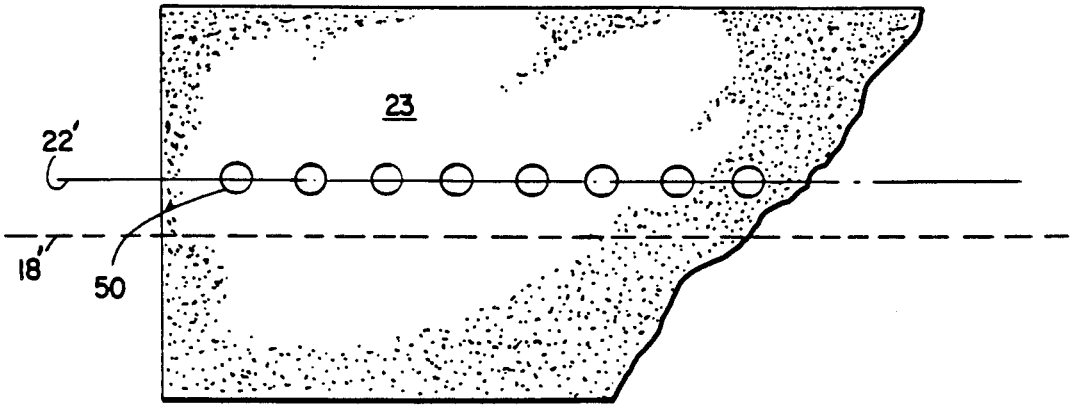
FIG. 4*b* is a plan view of such emery sheet with holes.
Figure 4C:
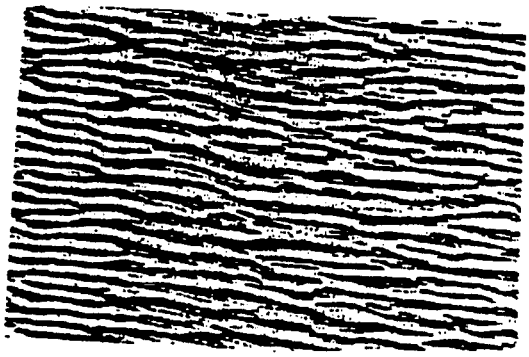
FIG. 4*c* is a plan view based upon a photograph, showing a tree bark pattern in the textile web treated according to FIG. 4*a;*

FIG. 4*a* is similar to FIG. 4 except that disruptions in the form of holes 50 (and see FIG. 4*b*) are provided in the emery cloth at the end of the primary member for production of a tree bark effect in a textile web 20, as illustrated in FIG. 4*c*.

Contrary to a common desire to have well-defined, completely continuous crepes or ridges in a textile fabric, the tree bark effect is characterized by a somewhat random widthwise discontinuity of the crepe formations, in which certain crepe formations end and others begin, and still others merge or branch. An acceptable product must, over all, have a generally uniform appearance so that while randomly distributed, the general frequency and nature of the discontinuities must be uniform.

Such a tree bark effect has previously been produced in textiles at high temperature (e.g. 400° F.) and at slow speed (e.g. 10 yards per minute) on a limited commercial basis using a so-called bladed microcreper, but not at desired lower temperatures and much higher speeds. Aspects of the present invention are seen as making possible tree bark at higher commercial speeds.

To produce the tree bark effect an enlarged cavity is provided, chosen with respect to the particular fabric to be not so large as to induce secondary or superficial crepe upon previously formed crepe. Whereas the size of the cavity can often be chosen, for a particular speed, to produce the desired result, cavity sizing alone may be inadequate to assure production of the same tree bark effect over a wide range of speeds or other operating conditions. It has been found however that localized disruptions in the treatment cavity, such as produced by the holes 50 in the emery sheet at the end 22' of the primary member 22 introduce desired localized disturbances to the retarding action. These initiate the desired discontinuities in the creping action, to produce tree bark over a usefully widened range of operating conditions.

Other means of introducing discontinuities are possible, for instance, by localized deformations in the end of the primary member or by narrow slots (or even slits) formed in the emery sheet, lying at an acute angle of e.g. 20° to the machine direction. The angled relationship of the slots ensure that all portions of the web traverse some retarding surface so that striations or other linear artifacts in the treated web, in the machine direction, when not wanted, can be avoided.

Figure 5:
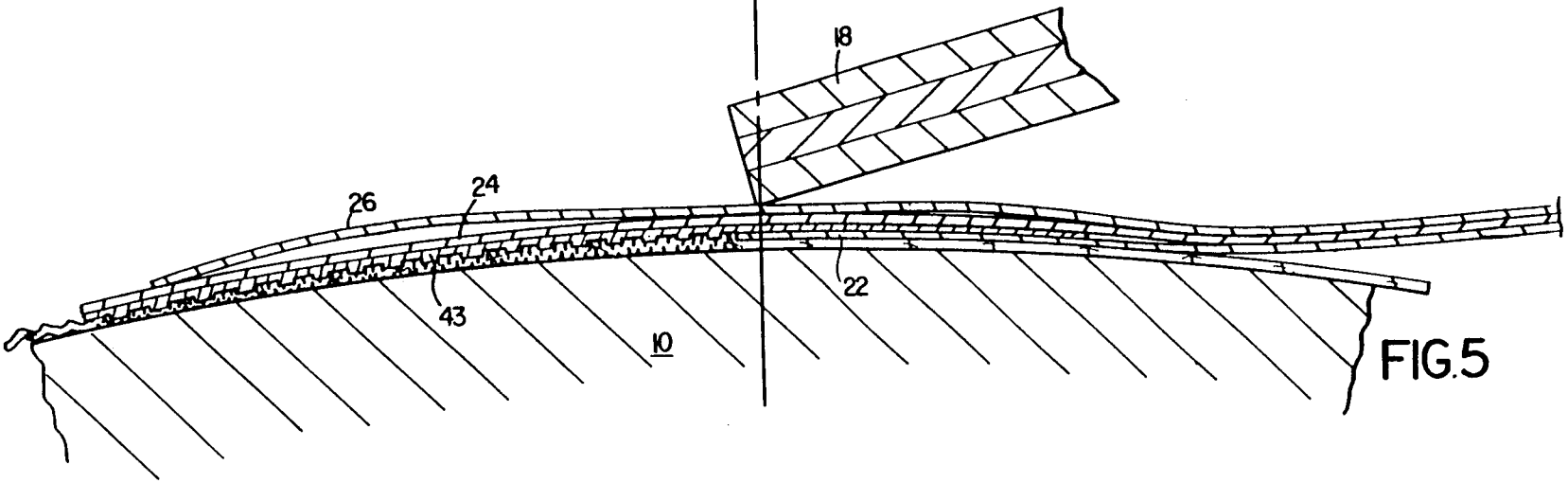
Figure 5B:
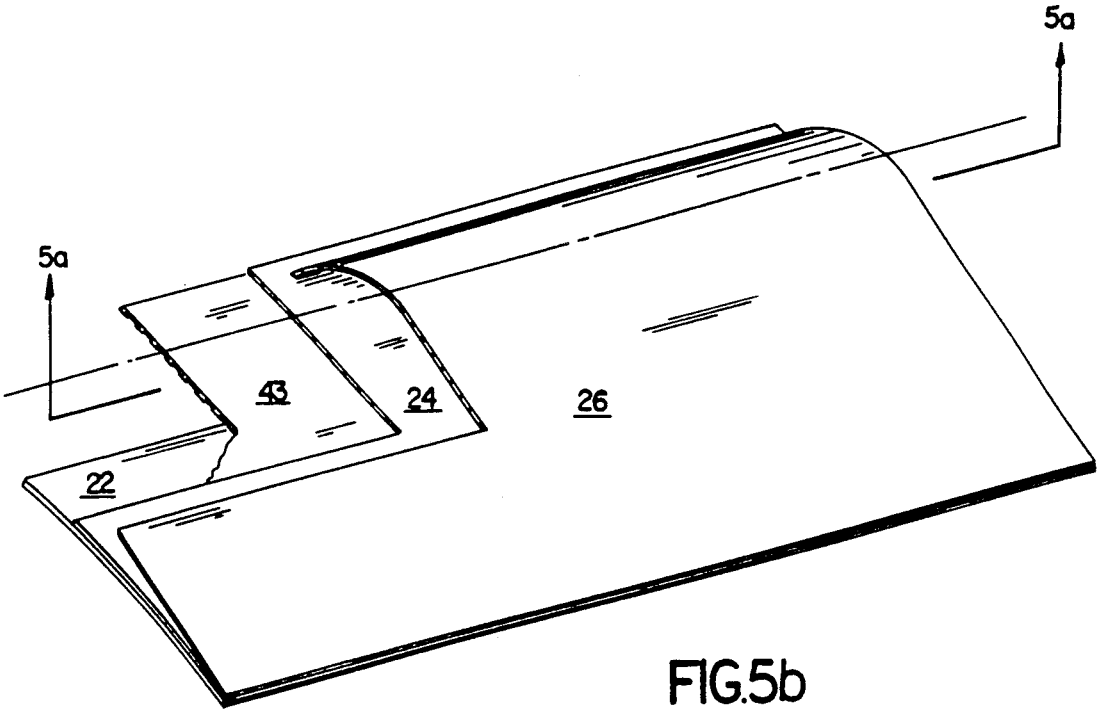
FIG. 5*a* is a plan view of the surface of such retarding member and FIG. 5*b* is a perspective, partially cut away view showing the primary and retarder package used in the embodiment of FIG. 5.
Figure 5A:
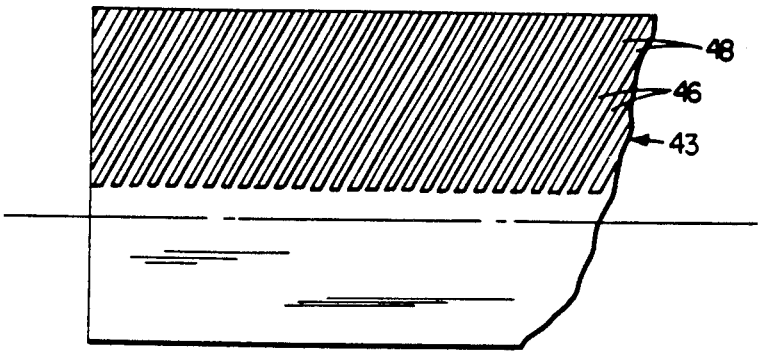

The embodiment of FIG. 5 employs a sheet metal retarding member 43 having a dense series of angled ridges 45 and grooves 47 as shown in FIG. 5*a*, assembled in the package shown in FIG. 5*b*. The ridges and grooves may be formed of non-abrasive material such as polished steel. Depending upon the treatment cavity geometry and the angle chosen for these ridges and grooves it is possible for such a retarder surface to induce desired discontinuities as the web "ratchets" over the ridges and grooves, to produce a desired tree bark effect.

Of more general interest, the ridges and grooves produce a retarding effect by back-pressure caused by angled opposition to the forward travel of the web produced by the ridges. With certain amenable materials, such as knit fabrics, the idges and grooves are arranged to channel the web to move bodily in the angled direction of the ridges to produce the needed resistive pack of creped or compacted material at the treatment cavity, against which the oncoming fresh material can be longitudinally compressed, thus avoiding any abrasion to the web.

These and other features and advantages of such a bias retarding device are disclosed in copending U.S. Patent application Ser. No. 035,268, filed Apr. 2, 1987, which is hereby incorporated by reference.

Figure 6:
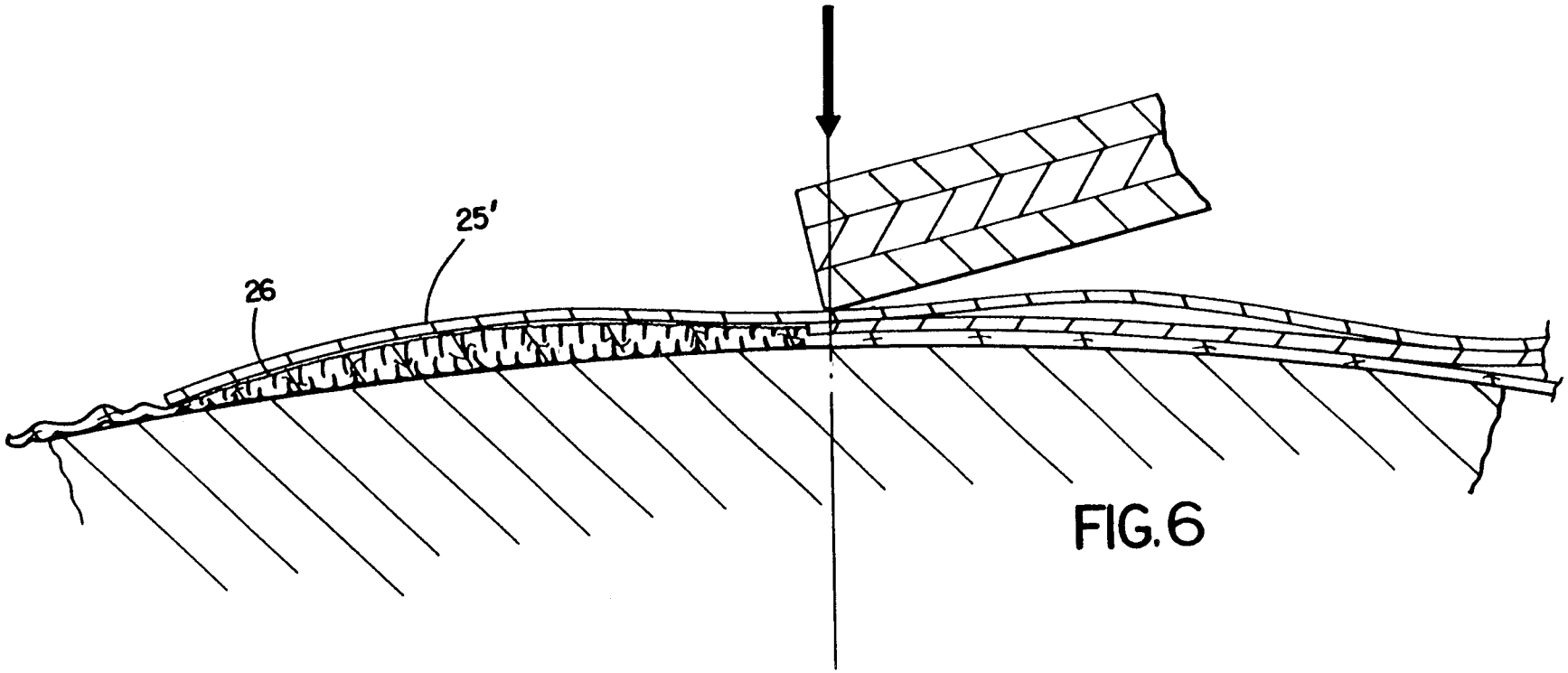
FIG. 6 is a view similar to FIG. 3 showing an arrangement using the gull-wing form sheet spring member as the support of a retarding surface to produce a tree bark effect.

In FIG. 6 another means of forming a tree bark effect is shown. In this case a retarding surface 25' of carbide particles is applied to the under surface of the second spring member 26 while the first spring member is omitted from the package. The relatively large nature of the crepes and the fact that a certain degree of irregularity of treatment is desired make it possible in this case to omit the first spring member.

Figure 7:
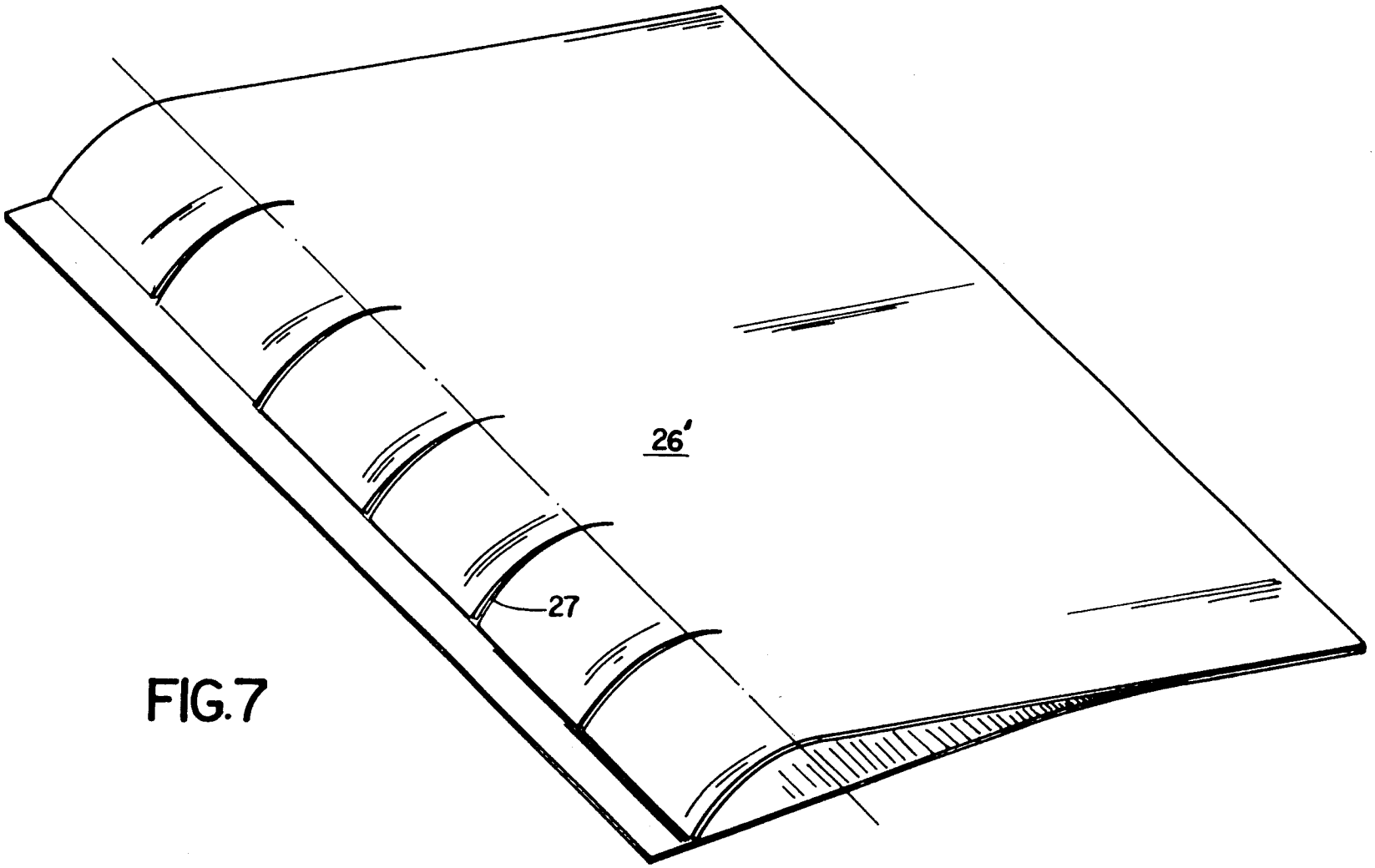
FIG. 7 is a perspective view of another sheet spring package useful according to the invention.

The package illustrated in FIG. 7 employs a second spring sheet 26' which has a series of machine direction slits 27 in its trailing edge. These introduce a certain responsiveness o the second sheet member to local conditions under the retarding surface, in some cases facilitating the smooth flow of the process.

Figures 8, 8A:
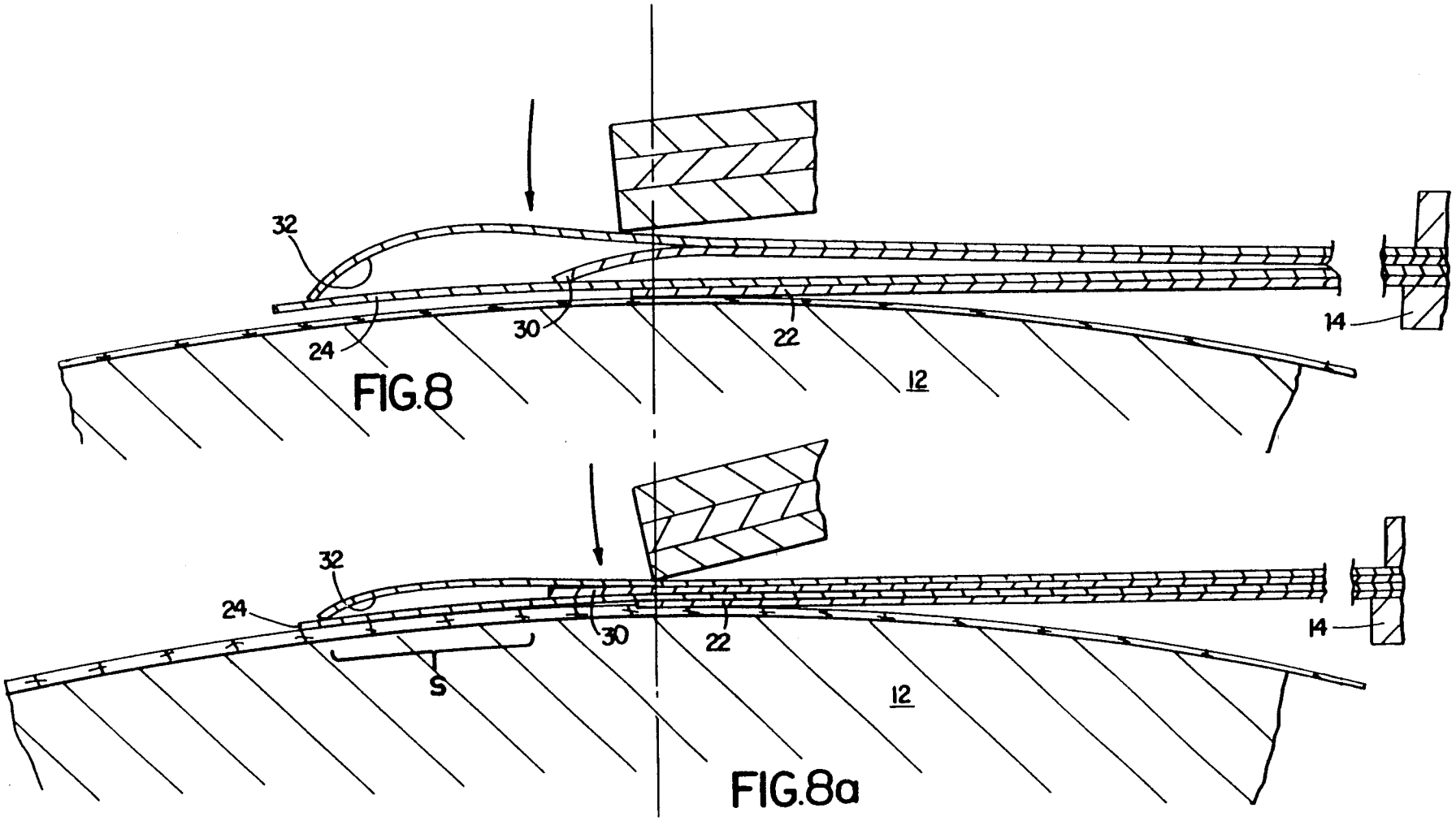
FIG. 8 is a view similar to FIG. 2*a* of another embodiment embodying two cantilevered, precurved supplemental sheet spring members while FIG. 8*a*, similar to FIG. 2*c*, shows the embodiment in operative condition.

In the embodiment of FIGS. 8, 8*a*, two precurved supplemental spring members 30 and 32 are supported in cantilever fashion by holder 14. The shorter member 30 has its tip in the region immediately downstream of the end of the primary member 22, and serves, in operative position (FIG. 8*a*) to provide stabilization to the treatment cavity. The longer member 32 has its tip engaged upon the downstream end of the first sheet spring member, and causes the latter's deflection about the roll.

Figure 9:
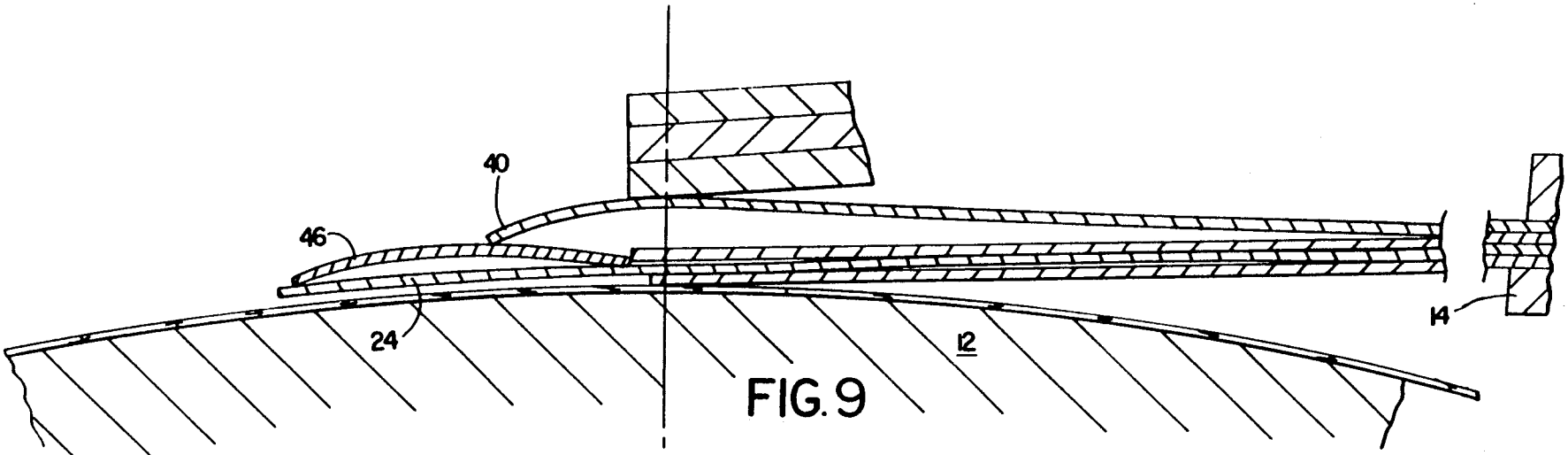
FIG. 9 is a view similar to FIG. 2*a* of yet another embodiment employing a different combination of two precurved supplemental sheet spring members, while FIG. 9*a*, similar to FIG. 2*c*, shows its operative condition.
Figure 9A:
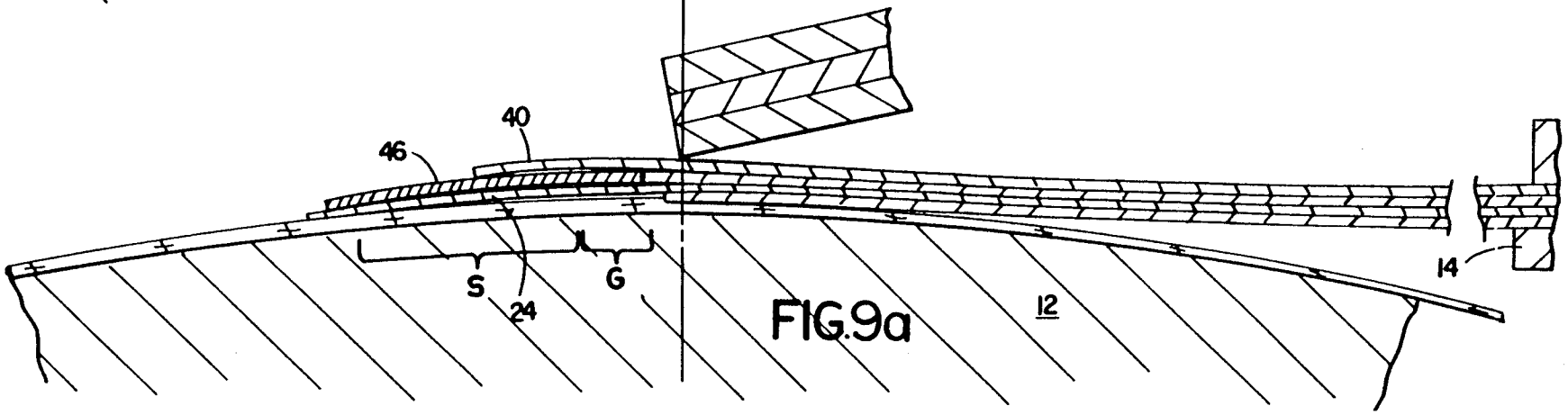

In the embodiment of FIGS. 9, 9*a* a short precurved member 42 is landed on opposite ends of the portion of the first support spring 24, to provide, respectively, cavity stabilization and tip deflection. The second precurved member 40 extends from its cantilevered support to the mid region of the short member 42, to apply deflecting pressure in response to the presser member edge 18'.

In the embodiments of FIGS. 8*a* and 9*a* it is seen that there is a span S between stabilized treatment cavity and tip, in which the first sheet spring member is relatively unsupported, and free to provide a degree of resilient support to the confined web traveling beneath it.

Although presently preferred embodiments, e.g. FIGS. 1, 8 and 9, employ a curved driving roll, it will be understood that many aspects of the invention including the gull-wing feature and alternative arrangements such as those of FIGS. 8 and 9, are applicable to a moving web-driving belt having an appropriate driving surface. The web compressing action may take place at the location of a guide roll, in which case the belt has the curved form of its guide, or in some advantageous cases the action may occur at a point where the belt is flat. In the latter case, a back support may be employed under the moving flat belt where the belt itself does not offer sufficient stability. One use for such a belt is the creping of a web on the bias, in which case the presser edge may be arranged at an angle to the direction of travel of the belt.

Because of the ability of the foregoing gull wing and other features to make commercial operations feasible, certain ridge and groove retarding techniques that we have developed gain new importance. These will be described now in detail.

We previously showed such a retarder in FIG. 5.

Referring now to FIGS. 10, 11, 12 and 13, the retarder member 40 has a special web engaging surface comprised of a series of relatively closely spaced retarding ridges 46 separated by groove passages 48. In most preferred embodiments the ridges are comprised of hard, smooth, polished substance, e.g. hardened spring steel, upon which the web material can readily slide. The leading edges $E_L$ of these ridges, which are opposed to the movement of the oncoming web, do the major work.

In the embodiment shown, the ridge and groove configuration is formed by sequential grinding of the face of a blue steel sheet with a narrow diamond grinding wheel, or alternately they ma be formed by etching. In either case the edges are formed by the intersection of two different surfaces, as shown being a substantially planar top surface of a ridge and a side surface of a ridge, so that the resultant edge $E_L$ has a web-surface-indenting capability. The ridges and grooves extend at angle a relative to the machine direction S, angle a varying in value from about 10° to about 60° (often preferably between 30°, preferred for stiff webs, and 45°, preferred for soft, flexible webs) depending upon the nature of the material to be treated and the properties desired to be achieved by the treatment. In the embodiment shown in FIGS. 10–13, angle a is 45°.

Figure 13:
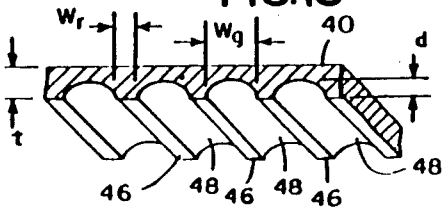
FIG. 13 is a perspective view on a magnified scale of a portion of the retarding element of FIG. 12.

Referring to FIG. 13, the blue steel is of thickness, t, of 0.020 inch. The grooves are formed to a depth, d, sufficient to ensure that the leading edge $E_L$ of each ridge 46 is sharp, depth, d, typically being 0.010 inch. In the embodiment shown grooves 48 have widths $W_g$ of 0.040 inch. These grooves are formed on 0.050 inch centers, giving a ridge width $W_r$ of 0.010 inch. The ridges 46 and grooves 48 extend across the full width of the web 16 and have a density, in this embodiment, sufficient to produce a uniform treatment of a wide variety of web materials. In the embodiments shown, the ridges and grooves extend to the downstream extremity of the retarding member.

Figure 10:
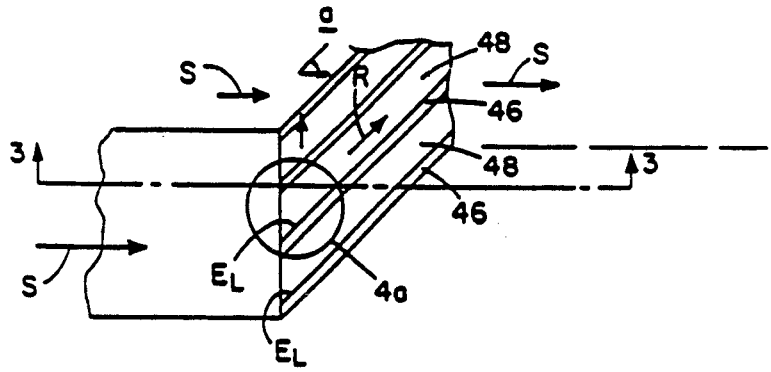
FIG. 10 is a diagrammatical plan view on a magnified scale of a critical portion of the compressive treatment cavity of an improved microcreper machine.
Figure 11:
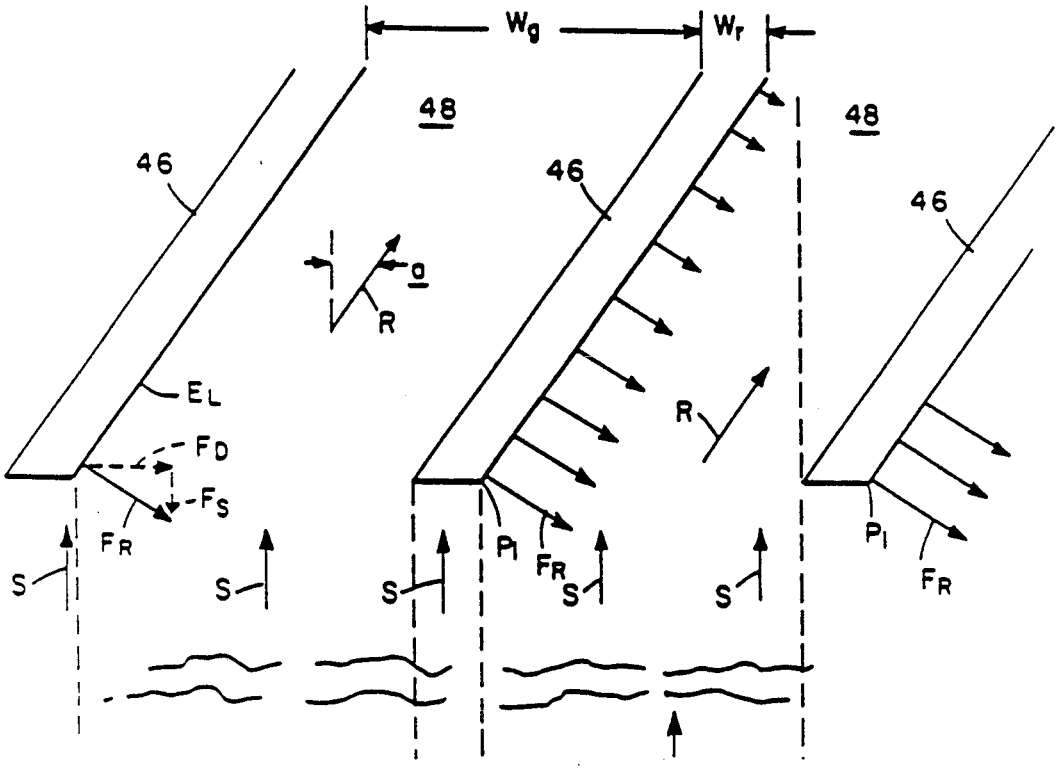
FIG. 11 is a view similar to FIG. 10 on an even more magnified scale.
Figure 12:
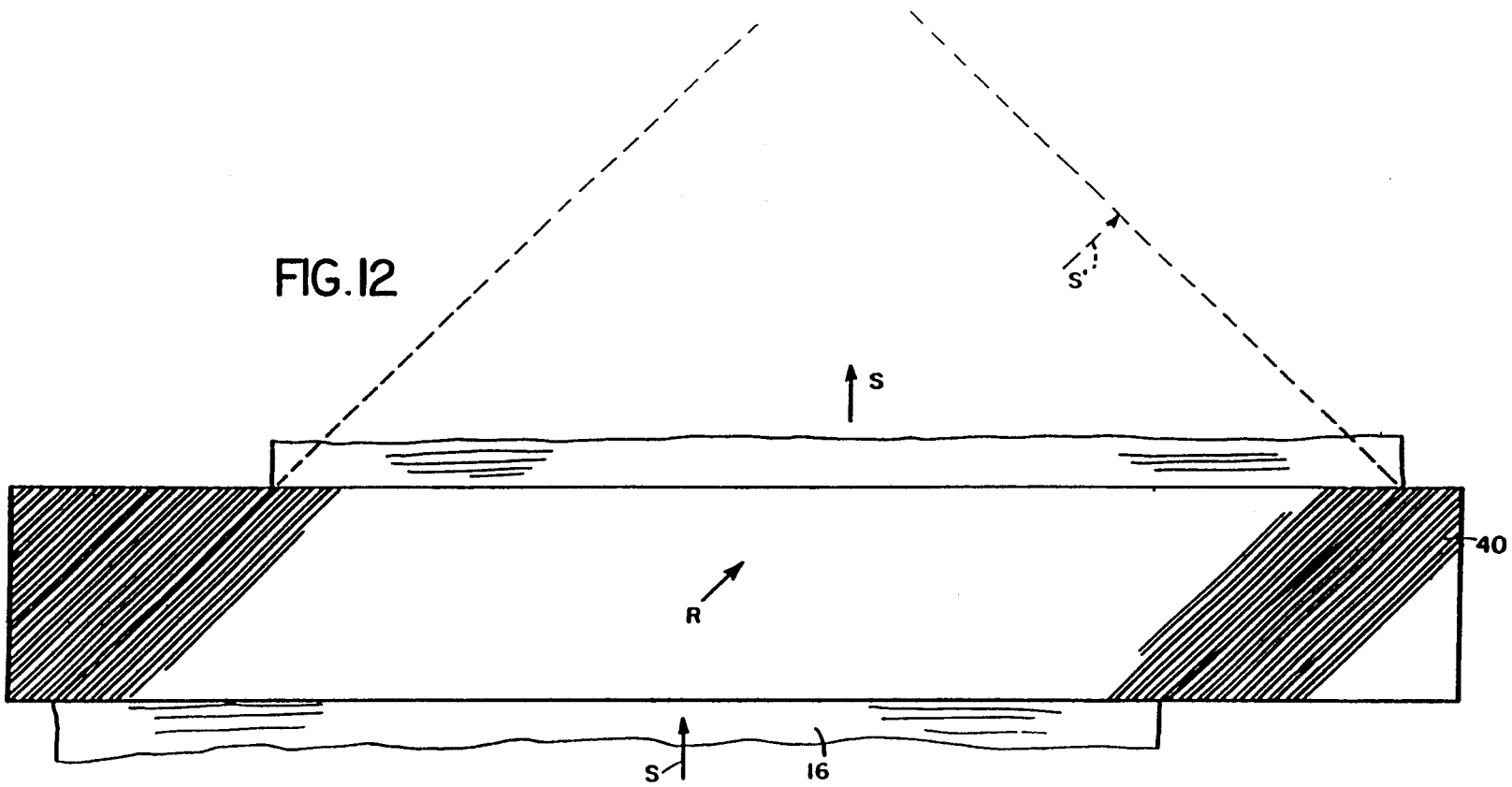
FIG. 12 is a plan view of the novel retarding element of this embodiment featuring parallel retarder ridges set at an acute angle that act upon the face of the material to retard it by an angled opposing effect, the outline of the path of the fabric past the retarding element also being shown.

As shown in FIG. 10, 11, and 12, with amenable webs, such as knit fabrics, the web which moves under the primary member 18 in the machine direction S, is diverted to direction R during its travel under the retarding member 40, is drawn off of the machine from under the end of the retarding member in machine direction S, as is shown in solid lines in FIGS. 12, and is wound upon a roll. In an alternate embodiment, as suggested in dotted lines in FIG. 12, the web may be withdrawn at an angle S' from the machine direction, an angle which may correspond to the direction of the ridges, or may be at less of an angle to the machine direction, depending upon the nature of the treatment desired.

The leading edge $E_L$ of each of the ridges 46 faces into the incoming material and its initial part $P_i$ is effective to apply a retarding force to the web. Referring to FIG. 10 and 11, any web segment, as it reaches a leading edge $E_L$, encounters a resistance force $F_R$ normal to the direction of extent of the resistance edge $E_L$. This force $F_R$ can be resolved into a force component $F_S$ which acts in opposition to the machine direction feed of the material and a diverting force component $F_D$ which acts in the direction at right angles thereto. $F_D$ tends to divert the web from the direction S to direction R, at angle a of the ridges and grooves. This interaction of the web with the resistant edges $E_L$ is repeated at every increment of 0.050 inch across the width of the material, with the aggregate result that the entire web is bodily transformed from movement in the machine direction S to the temporary direction R set at angle a.

It appears, as suggested in FIG. 11, that the resistance force $F_R$ has decreasing effect on the web as the web contacts edge $E_L$ further from initial point $P_i$, due, perhaps, to the combined effect of all the edges $E_L$ on the oncoming web.

Figure 15:
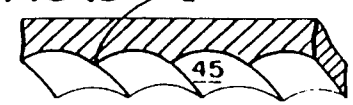
FIGS. 14 and 15 are views similar to FIG. 13 of alternate embodiments of the retarding element.
Figure 14:
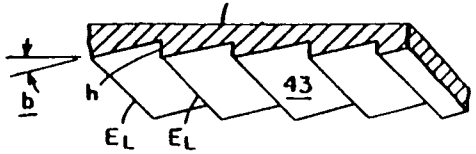

Since it is generally the leading edges $E_L$ of the retarding member that do the major work (and not the second or lazy edge on the other side of the ridge), it can be readily appreciated that other forms of a retarding surface can be employed. For instance, referring to FIG. 14, the retarding edges $E_L$ may be machined into a plate in the nature of a "checkmark" cross section in which the surface of the retarding member slopes at 43 from each edge $E_L$ at an angle b to the plane of extent of the retarding member 40'. The slope ends at the step surface h which rises to form the next retarding edge $E_L$, this being repeated across the full surface of the retarding member. In FIG. 15 an escalloped cross section is shown, with curved resistant edges $E_L$ formed by the intersection of adjacent concavely curved surfaces 45.

Operation of Embodiment of FIGS. 10–13

The web 20, as shown in FIG. 1, proceeds from a supply roll at the speed S of the driven roll 10. Initially, to start the action, the web is laid beneath the primary member 22 and retarding member 40 in untreated position and presser member 18 is pressed downwardly to press the primary member 22 against the web 20. This causes the roll 10 to drive the web forward. Retarding of the web is initiated to cause a "build back" of a column of compressively treated web by the action of primary member 22 and retarding member 40 on the web or by the operator by hand. Thus, the condition of FIG. 5 is achieved during start-up. The operator quickly releases the temporary pressure, if applied, and the retarding member thereafter can perform its retarding function without need of pressure beyond that provided by the set up shown. As the fresh web 20 reaches the treatment cavity (which may be under the primary or at its end), each element of web 20 is subjected to a forward driving force due to the action of the roll and a backward retarding force. At this point an initial compressive treatment occurs and the treated web slips on the roll 10. In the case of thin webs subject to creping such as tissue paper or nonwovens, an initial, extremely fine microcrepe may be formed, which may be only a few thousandths of an inch in height. In the case of textiles, compaction occurs with microcreping of component fibers, without creping of the overall fabric. As the driven roll continues to turn, this web reaches the end 22' of the primary member 22. At this point the web is free to expand or bloom (as with textiles) or crepe (as with paper) into coarser crepe in the treatment cavity whose height is determined by the thickness of the primary member. In either event the face of the material extends somewhat into the grooves 48, while the ridges 46, or at least the leading edges $E_L$, bear into the surface of the microcreped material to apply the retarding forces described in FIG. 11. The set of diverting forces $F_D$ at the leading edges $E_L$ of all of the ridges has the aggregate effect of diverting the web to move in the direction of the grooves, R, as a column of compressed material, proceeding at speed slower than that of the roll 10. The roll surface slips beneath the treated material. The drive forces of the roll as well as certain drag effects of the roll slipping beneath the treated web advance the web through the grooves 48 in channelled flow until the web is released from the retarding member 40. At that point, as shown in FIG. 12 in solid lines, and as well in FIG. 16, the treated web is wound up by roll 32 which pulls the web in direction S, in a path that is offset by distance D as shown in FIG. 16 due to the diverted movement of the web.

In the treatment of a thin polyester tricot knit fabric of approximately 0.015 inch thickness, the web goes through a number of stages, i.e. drive, treatment, retarding, setting and windup. The knit fabric as it is led in has lines of knit extending in parallel, perpendicular to the machine direction S. These lines of knit never turn. Even in the retarding region, they remain parallel in the crosswise direction. As the web is driven forward it undergoes a compressive treatment. The compressed web readily expands, being soft and pliable, and fills the grooves 48. Because of the smooth surface of the grooves and ridges, the web remains uniform, without picks or abrasion. It is drawn off in the direction S, as previously mentioned, and passes through a cooling region.

The compressive treatment causes the fibers of the polyester to bloom and makes the fabric much softer to the touch and more drapable while the cooling region sets this treatment.

It will be further appreciated that other variations in the use of the invention can be employed. The ridges and grooves can be curved (FIG. 15) instead of straight and may even have re-entrant curves of S form or zigzag configuration to some extent, all for the retarding purposes described above. For variation in the treatment across the width of the web, it should be noted that in certain materials, and with suitable arrangements of the retarding ridges, the highest degree of compaction can occur immediately adjacent retarding edge $E_L$ while in a wide groove adjacent to this ridge a region, remote from the retarding edge $E_L$ (e.g. next to the lazy edge in FIG. 10) can have less compressional pressure applied and less permanent compression effects. The resulting web can have, where desired, a gradation of treatment. The treatment over wide lands is another example where a differing kind of treatment can be provided. In many instances the web is subjected to twisting and shear effects in its own plane in a manner very unusual, resulting in greater softening and other desired effects.

It will be understood that numerous further embodiments not illustrated here can employ features of the present invention. The web driving surface might be a roll having grooves such as those illustrated in Packard U.S. Pat. No. 4,090,385, or indeed might be provided by a belt traveling over a support roll or over a flat support as mentioned above. Of particular worth to mention is the ability to achieve plisse effects in finely treated fabrics using suitable interruptions of the retarder surface or the primary member at places across the width of the machine.

What is claimed is:

1. A web treating machine of the type comprising a drive member having a web-gripping drive surface, a smooth-surfaced primary member arranged over the drive member to press the web into driven engagement with the surface of the drive member, and a generally stationary retarding surface arranged after the primary surface to engage and retard the web before the web has left the drive member, the retarding surface being supported by a sheet form support member, having the following combination of features:

a) said sheet form support member is a longitudinally inextensible, elastically deflectable spring member, b) a tip deflector is constructed and arranged to apply deflecting pressure on the downstream end portion of said longitudinally inextensible support member to deflect said support member toward said drive member, c) there being a cavity stabilizer in the form of a portion of a second sheet form member which extends in face-to-face reinforcing relationship over the initial portion of said support member in the region immediately downstream of said primary member, thereby providing in said region a dimensional stabilizing effect in the normal direction to the cavity defined between said longitudinally inextensible sheet-form support member and said web-gripping drive surface, d) the portion of said longitudinally inextensible support member extending between said cavity stabilizer and said tip deflector being relatively reinforced.

2. A web treating machine of the type comprising a drive member having a curved web-gripping drive surface, a smooth-surfaced primary member arranged over the drive member to press the web into driven engagement with the surface of the drive member, and a generally stationary retarding surface arranged after the primary surface to engaged and retard the web before the web has left the drive member, the retarding surface being supported by a sheet form support member, having the following combination of features:

a) said sheet form support member is a longitudinally inextensible spring member elastically deflectable about the curved drive surface by applied tip pressure from a relatively straight unstressed shape to a bowed, elastically deformed shape that generally conforms to the curvature of the drive surface, b) a tip deflector is constructed and arranged to apply deflecting pressure on the downstream end portion of said longitudinally inextensible support member to deflect said support member into conforming relationship with said drive member, c) there being a cavity stabilizer in the form of a portion of a second sheet form member which extends in face-to-face reinforcing relationship over the initial portion of said support member in the region immediately downstream of said primary member, thereby providing in said region a dimensional stabilizing effect in the normal direction to the cavity defined between said longitudinally inextensible sheet-form support member and said web-gripping device surface, d) the portion of said inextensible support member extending between said cavity stabilizer and said tip deflector being relatively unreinforced.

3. The machine of claim 1 or 2 wherein said tip deflector is comprised of a sheet spring member in face-to-face engagement with the upper surface of the end portion of said support member.

4. A web treating machine of the type comprising a drive member having a web-gripping drive surface, a smooth-surfaced primary member arranged over the drive member to press the web into driven engagement with the surface of the drive member, and a generally stationary retarding surface arranged after the primary surface to engage and retard the web before the web has left the drive member, the retarding surface being supported by a sheet form support member, having the following combination of features:

a) said sheet form support member is elastically deflectable, b) a tip deflector is constructed and arranged to apply deflecting pressure on the downstream end portion of said support member to deflect said support member toward said drive member, c) there being a cavity stabilizer in the form of a portion of a second sheet form member which extends in face-to-face reinforcing relationship over the initial portion of said support member in the region immediately downstream of said primary member, thereby providing in said region a dimensional stabilizing effect to the cavity defined between said sheet form support member and said web-gripping drive surface, d) the portion of said support member extending between said cavity stabilizer and said tip deflector being relatively unreinforced, e) said tip deflector and said cavity stabilizer comprising spaced apart portions of a supplemental sheet spring member, the portion of said supplemental sheet spring member that defines said tip deflector being in face-to-face engagement with the upper surface of the end portion of said support member, said supplemental sheet spring member having, in unstressed condition, a precurved, outwardly convex portion spanning between said portions that define said cavity stabilizer and said tip deflector.

5. The machine of claim 4 wherein said primary member is of sheet form, an extension of said supplemental sheet spring member extends upstream of the portion that defines said cavity stabilizer, said extension lying over said primary member, and a presser member for pressing said extension downwardly whereby said extension in turn can press said primary member downwardly into engagement with said web, said members constructed and arranged such that the downward pressure of said presser member serves to urge said tip deflector and said cavity stabilizer portions of said supplemental sheet spring member into engagement with respective portions of said support member.

6. The machine of claim 5 wherein, in unstressed condition, said upstream extension is precurved, outwardly convex over a region immediately upstream of said presser member, as a continuation of the curve of said supplemental member downstream of said presser member.

7. The machine of claim 5 wherein said drive member is a driven roll and said presser member comprises a presser edge that extends in the direction of the length of the roll.

8. The machine of claim 5 wherein said supplemental sheet spring member is constructed and arranged so that in operating position said presser member locally, elastically deflects said sheet spring member into a slightly reversely curved, outwardly concave form whereby in the region of said presser member and immediately upstream and downstream thereof, said sheet spring member has a stable prestressed, generally gull-wing shape.

9. The machine of claim 4 wherein said primary member comprises a sheet metal member, and upstream extensions of said primary member, said support member and said supplemental sheet spring member extend upstream to a common holder which grips them face-to-face.

10. The machine of claim 1 or 2 wherein said support member is of blue steel having thickness greater than about 0.010 inch.

11. The machine of claim 10 wherein said thickness of said support member is less than about 0.020 inch.

12. The machine of claim 10 wherein a supplemental sheet form member forms the tip deflector and cavity stabilizer, said supplemental sheet form member being of blue steel and thickness greater than about 0.010 inch and no thicker than about the thickness of said support member.

13. The machine of claim 1 or 2 wherein a smooth sheet form, low-friction roof member extends downstream a limited distance from the end of said primary member to the effective beginning of said retarding surface.

14. The machine of claim 13 wherein said roof member is comprised of blue steel of a sheet of about 0.003 inch thickness and extends downstream from the end of the primary member no more than about one half inch.

15. The machine of claim 1 or 2 wherein said retarding surface commences at the end of said primary member.

16. The machine of claim 1 or 2 wherein said retarding surface has an effective downstream extent of between about ½ and 1½ inches.

17. The machine of claim 1 or 2 wherein the retarding surface is defined by an emery sheet lying below said support member.

18. The machine of claim 1 or 2 wherein the retarding surface is formed integrally with the under surface of said support member.

19. The machine of claim 1 or 2 wherein the retarding surface comprises a large multiplicity of successive ridges and grooves set acutely to the machine direction.

20. The machine of claim 19 wherein the ridges and grooves are defined by low friction surfaces.

21. The machine of claim 1 or 2 wherein there are a widthwise distribution of interruptions of a surface in the region of the treatment cavity to enable production of or discontinuous effect such as a tree bark effect.

22. The machine of claim 21 in which a series of spaced apart open areas are provided in the retarder surface to provide said interruptions.

23. The machine of claim 22 in which said retarder surface is provided by emery cloth and said open areas are provided by holes formed in the cloth.

24. The machine of claim 22 in which said retarder surface is provided by emery cloth and said open areas are provided by angled slits or slots formed in said emery cloth.

25. The machine of claim 21 wherein said interruption comprise deformations in the end of said primary member.

26. In a web treating machine of the type comprising a drive member having a web-gripping drive surface, a smooth surfaced sheet-form primary member arranged over the drive member to press the web into driven engagement with the drive surface, a presser member defining a presser edge for pressing said primary member against the drive member and a generally stationary retarding surface arranged after the primary surface to engage and retard the web before the web has left the drive member, the retarding surface being supported by a sheet spring member which has a rearward portion extending rearwardly over the primary member and under said presser member, the improvement wherein said sheet spring member has, in unstressed condition, a precurved, outwardly convex portion spanning between a point upstream of said presser member edge to a region substantially downstream of said edge, said sheet spring member being constructed and arranged so that, in operating position, said presser member locally elastically deflects said sheet spring member into a slightly reversely curved, outwardly concave form whereby in the region of said presser member and immediately upstream and downstream thereof said spring member has a stable prestressed generally gull-wing shape.

27. The machine of claim 26 in operative position wherein spaced upstream of said presser member said sheet spring member is bowed out of contact with said primary member as a result of said gull-wing shape.

28. The machine of claim 26 in operative position wherein immediately downstream of said presser member the end of said primary member is reinforced against upward deflection by engagement of an upwardly concave portion of said gull-wing shape.

29. The machine of claim 26 in operative position wherein the portion of said sheet spring member in the region of the tip of said primary member and immediately beyond is under a bend-resistant prestressed condition as a result of said gull-wing formation, thereby being resistant to deflection by deflection forces applied to the downstream tip of said sheet spring member.

30. The machine of claim 29 wherein a sheet form support member lies between said primary member and said sheet spring member, said sheet form support member extending downstream of the tip of said primary member to define a treatment cavity and said sheet spring member immediately beyond said primary member engaging the upper surface of said support member in reinforcing relation to resist change in the depth of the cavity at the end of said primary member.

31. The machine of claim 29 wherein said sheet spring member is exposed to directly support a retarding surface.

32. The machine of claim 31 wherein said retarding surface is defined by emery cloth extending below said sheet spring member.

33. The machine of claim 31 wherein said retarding surface is defined by an abrasive coating carried on the under surface of said sheet spring member.

34. The machine of claim 4, 5, 6, 7, 8 or 9 wherein said drive member has a curved web-gripping surface, said sheet form support member is elastically deflectable about the curved drive surface by applied tip pressure from a relatively straight unstressed shape to a bowed, elastically deformed shape that generally conforms to the curvature of the drive surface, and said tip deflector is constructed and arranged to apply deflecting pressure on the downstream end portion of said support member to deflect said support member into conforming relationship with said drive member.

* * * * *

UNITED STATES PATENT AND TRADEMARK OFFICE

CERTIFICATE OF CORRECTION

PATENT NO. : 5,060,349

DATED : October 29, 1991

INVENTOR(S) : Richard R. Walton et al.

It is certified that error appears in the above-identified patent and that said Letters Patent is hereby corrected as shown below:

Col. 3, line 22; "comprises" should be --comprised--;

Col. 7, line 8; "25" should be --26--;

Col. 9, line 33; "idges" should be --ridges--;

Col. 9, line 56; "o" should be --of--;

Col. 10, line 49; "ma" should be --may--

Signed and Sealed this

Seventeenth Day of August, 1993

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,060,349

DATED : October 29, 1991

INVENTOR(S) : Richard R. Walton et al.

It is certified that error appears in the above-identified patent and that said Letters Patent is hereby corrected as shown below:

Col. 13, lines 57-58; "reinforced" should be --unreinforced--.

Signed and Sealed this

Twenty-fourth Day of January, 1995

*Attest:*

*Attesting Officer*

Bruce Lehman

BRUCE LEHMAN

*Commissioner of Patents and Trademarks*